United States Patent [19]

Mondini et al.

[11] Patent Number: 5,027,475

[45] Date of Patent: Jul. 2, 1991

[54] METHOD AND APPARATUS FOR AUTOMATIC PIECING OF COMBER LAPS

[75] Inventors: Gian-Carlo Mondini, Winterthur; Fredy Wichtermann, Effretikon; Helmuth Langel, Dubendorf; Heinz Clement, Winterthur; Oliver Wuest, Seuzach, all of Switzerland

[73] Assignee: Rieter Machine Works, Ltd., Winterthur, Switzerland

[21] Appl. No.: 552,697

[22] Filed: Jul. 16, 1990

Related U.S. Application Data

[63] Continuation-in-part of Ser. No. 431,431, Nov. 3, 1989.

[51] Int. Cl.[5] ..... D01G 19/08

[52] U.S. Cl. ..... 19/115 R; 19/215; 19/223

[58] Field of Search ..... 19/115 R, 215, 223

[56] References Cited

U.S. PATENT DOCUMENTS

| | | | |
|---|---|---|---|
| 2,154,281 | 4/1939 | Nasmith | 19/115 R |
| 2,559,074 | 7/1951 | Hinson | 19/215 |
| 3,479,699 | 11/1969 | Von Kaenet et al. | 19/223 |
| 4,419,791 | 12/1983 | Schär | 19/215 |
| 4,535,512 | 8/1985 | Glazener | 19/223 X |

*Primary Examiner*—Werner H. Schroeder
*Assistant Examiner*—John J. Calvert
*Attorney, Agent, or Firm*—Kenyon & Kenyon

[57] ABSTRACT

A textile machine is provided with apparatus for preparing the trailing end of a lap and a leading end of a fresh lap so that each end has a reduced fiber mass per unit length of lap in the prepared end. These lap ends are thereafter superimposed and joined together for subsequent processing in a combing unit of a combing machine or a drafting unit of a ribbon lap machine. The respective ends of the two laps may be prepared by a tearing action caused by clamping of the respective lap end between two spaced apart nip lines which are moved away from each other and wherein the spacing is slightly more than the length of the longest fiber in the lap. Preparation of a lap end may also be accomplished using a suction head for clamping of a lap along a nip line in order to carry out tearing of the lap to produced a prepared end.

30 Claims, 21 Drawing Sheets

METHOD AND APPARATUS FOR AUTOMATIC PIECING OF COMBER LAPS

This application is a continuation-in-part of Application Ser. No. 07/431/431, filed Nov. 3, 1989.

This invention relates to a textile machine for processing fiber feed material in the form of a lap. More particularly, this invention relates to a combing machine having at least one combing head comprising a combing unit and a carrier means for a roll of lap for combing. Still more particularly, this invention relates to a ribbon lap machine having a drafting arrangement and a carrier means for a roll of lap to be drafted.

As is known, combing machines which are supplied with a lap from a roll mounted on a carrier means have been provided with a detector means, for example comprising a photo-electric cell or a light barrier, in order to stop the machine when the end of a lap is reached. The carrier means is then refilled with a new lap roll either manually or by a transport means. The start of the lap from the new roll is then placed manually on the end of the lap from the previous roll (this end may, if required, have been torn to the correct length) and is connected thereto by pressure, whereupon the machine can be re-started. The overlap thickness created by this procedure (despite possible "plucking out" of the incoming lap end by the operator) causes a quality defect in the end product (combed sliver).

U.S. Patent Specification No. 2,559,074 describes a technique for automating the manual process described above. As described, the end of an incoming lap is superposed on the end of an outgoing lap upstream from the leading lap unwinding roller and the join (overlap) thus formed is passed along the normal lap movement path into the combing unit. The use of "comb teeth" to part the outgoing lap is also described, but this is a mere severing operation without any lap end preparation significance.

A device in accordance with U.S. Pat. No. 2,559,074 will at least give a severe quality defect due to the overlap and will possibly be inoperable due to blockage of the combing unit caused by the double thickness of feed material presented thereto.

Accordingly, it is an object of the invention to apply the start of a lap from a new roll to the end of a lap from a previous roll automatically and reliably without causing either a breakdown in the operation of a combing unit or other lap processing unit or an unacceptable deterioration in product quality.

It is another object of the invention to join lap ends in a lap processing machine in a simple reliable manner without introducing a quality defect at the joined ends.

Briefly, the invention provides a method of joining an incoming lap with an outgoing lap extending to a lap processing unit in a textile machine wherein both the trailing end of the outgoing lap and the leading end of the incoming lap are prepared, superimposed on each other and then joined together by pressing for feeding to the lap processing unit.

In one aspect of the present invention, an outgoing lap is joined to an incoming lap in a region downstream from a carrier for a feed lap. In order to enable this, a support means is provided to support a length of outgoing lap extending from the support means to the lap processing unit.

In a second aspect of the invention, a prepared end is formed (downstream from a carrier for a feed lap) on a length of lap extending to the lap processing unit, a prepared end is formed on an incoming lap and the prepared ends are brought together downstream from the carrier.

The invention also provides a textile machine such as a combing machine or a ribbon lap machine which has at least one lap processing unit and a carrier means for supporting a roll of lap to be processed with means to form a prepared end on an outgoing lap, means to support a length of the outgoing lap upstream from the lap processing unit with the prepared end in a substantially predetermined position, means to form a prepared end on an incoming lap, and means to bring the prepared ends together and to feed them to the lap processing unit.

A textile machine according to another aspect of the invention may have at least one lap processing unit and a carrier means for supporting a roll of lap to be processed with means to form a prepared end on an outgoing lap and a prepared end on an incoming lap, means to bring the prepared ends together by superposing one on the other and forwarding means for forwarding the laps with the superposed ends to the lap processing unit One embodiment of the invention may comprise (in accordance with pending U.S. Patent Application Ser. No. 07/431,431, filed Nov. 3, 1989, hereinafter referred to as the "prior application"), a combing machine having at least one combing head comprising a combing unit and a carrier means for a roll of lap for combing and having in the path of the lap from the roll to the combing unit a pair of transport rollers, means for severing a first lap from a first roll in order to form a first trailing lap end on the lap running to the combing unit and for severing a second lap from a new roll after the pair of transport rollers in order to form a second leading lap end and means for connecting the second lap end to the first lap end. In this embodiment, the means for connecting the lap ends includes a pair of pressing rollers disposed in the path of the lap and a movable deflector element disposed at the pair of rollers for at least one of the two lap ends for connection. In accordance with this embodiment, the severing means is adapted to form prepared lap ends suitable for overlapping and joining without generating a significant quality defect.

As described in the prior application, a detector means may additionally advantageously be provided to determine the time at which the first lap has approximately completely unwound from the first roll. The detector means can at that time start a control means which then actuates the means for severing the first lap, and then actuates a roll transport means for feeding a new roll to the carrier means, and then actuates the means for severing the second lap and then actuates the means for connecting the second lap end to the first lap end.

The invention is particularly suitable for a combing machine comprising one or more groups of combing heads, e.g. a group of eight combing heads or two groups each of six combing heads, the lap roll change in all the combing heads of a group being performed simultaneously in each case, the above-described control means simultaneously performing the actuations at all the combing heads of the group. To start the control means, it is advantageous to provide each combing head of the group with its own detector means so that the control means is triggered as soon as the first lap has approximately completely unwound from the first roll at a combing head of the group. The first laps are then automatically severed at the same height at all the combing heads of the group, new rolls are supplied, the second laps are severed from the new rolls at the same height and the lap ends are interconnected.

These and other objects and advantages of the invention will become more apparent from the following detailed description taken in conjunction with the accompanying drawings in which:

FIG. 1 diagrammatically illustrates a combing head of a combing machine according to the prior application, FIGS. 2 to 8 show details taken from FIG. 1 with the parts in different positions and states of operation;

FIG. 9 is a diagram of a combing head in accordance with European Patent Application No. 89105756 for comparison with systems according to the invention;

FIG. 10 is a diagram of an alternative type of combing head in accordance with U.S. Pat. No. 3,479,699;

Figure 1:
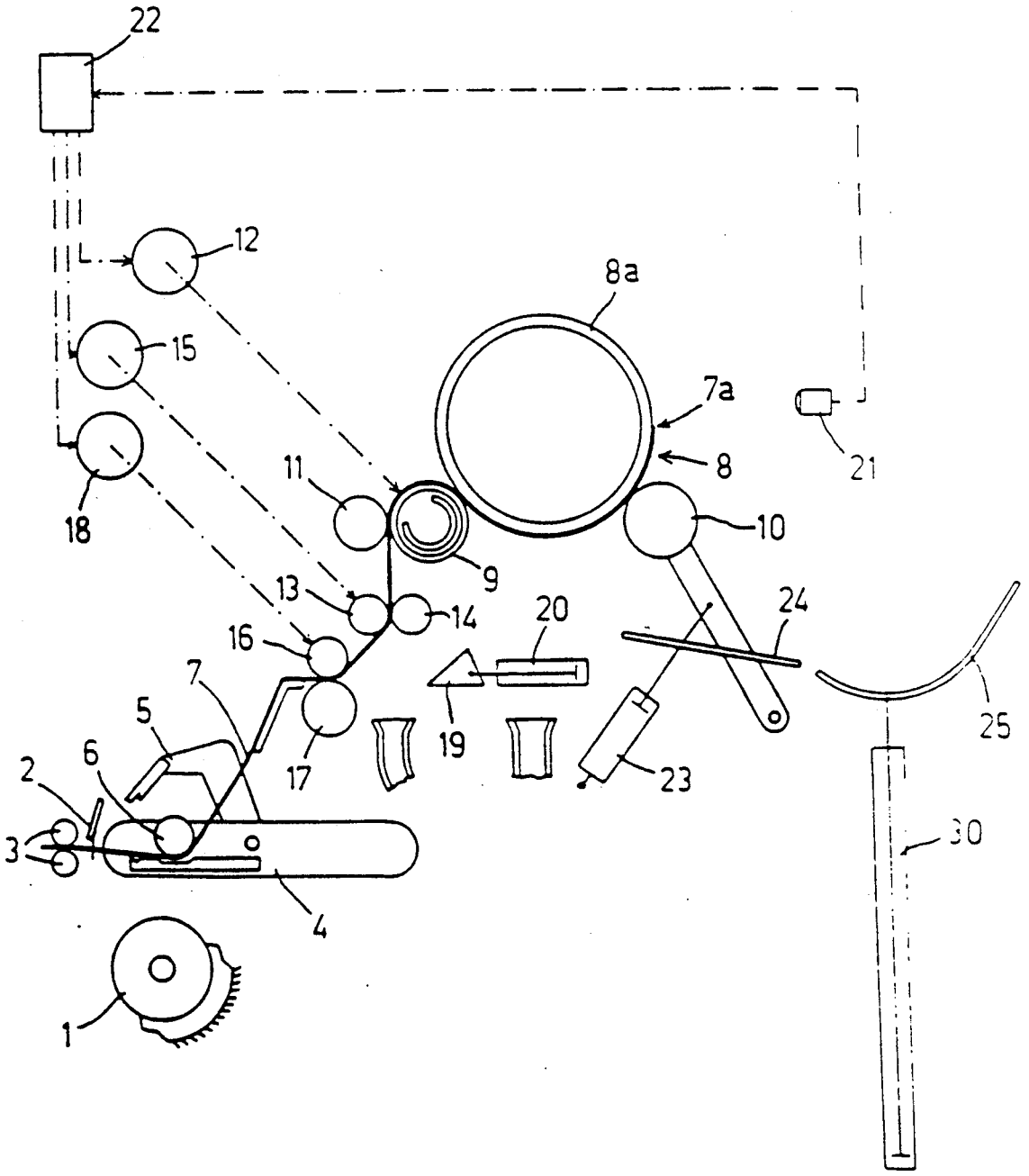
Figure 15A:
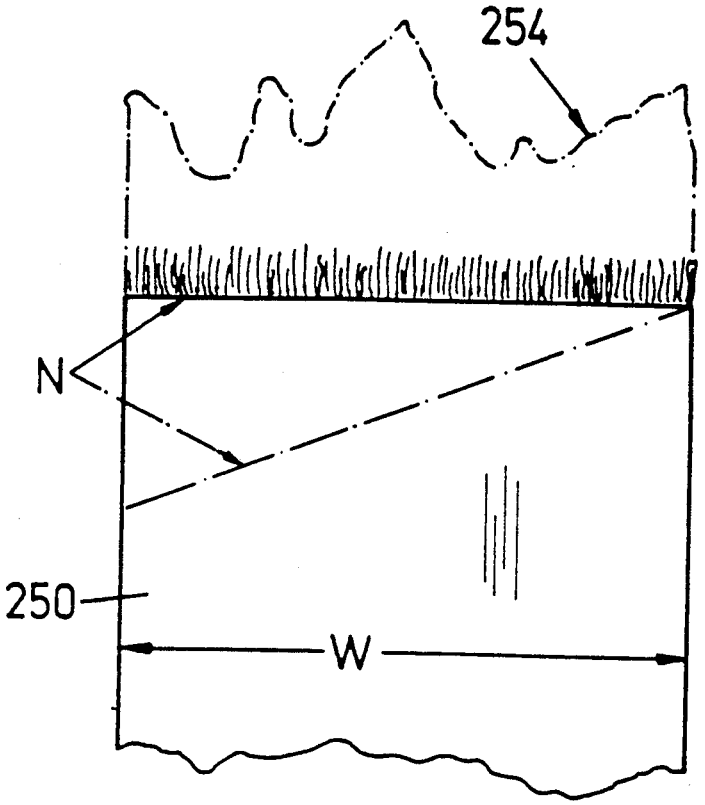
Figure 15B:
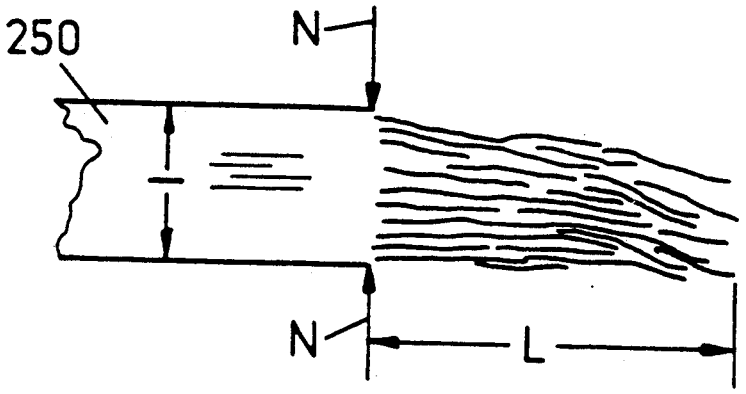
Figure 16:
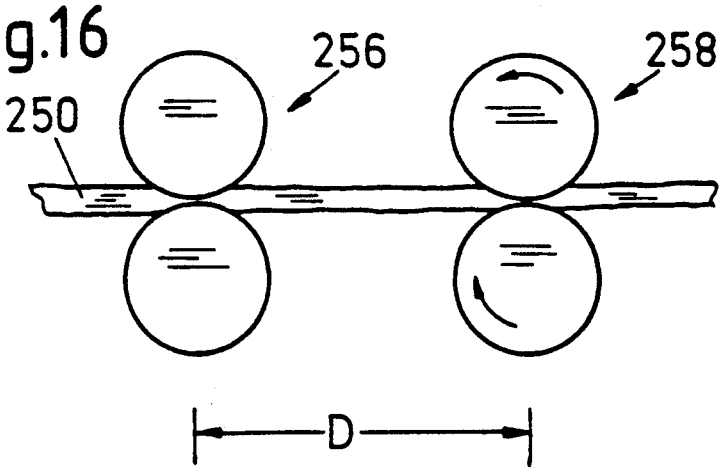
Figure 17:
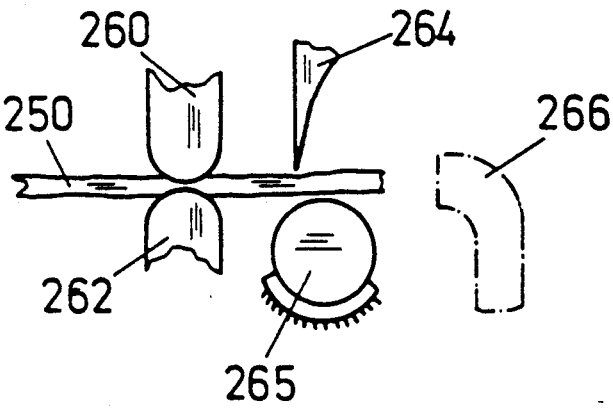
Figure 18:
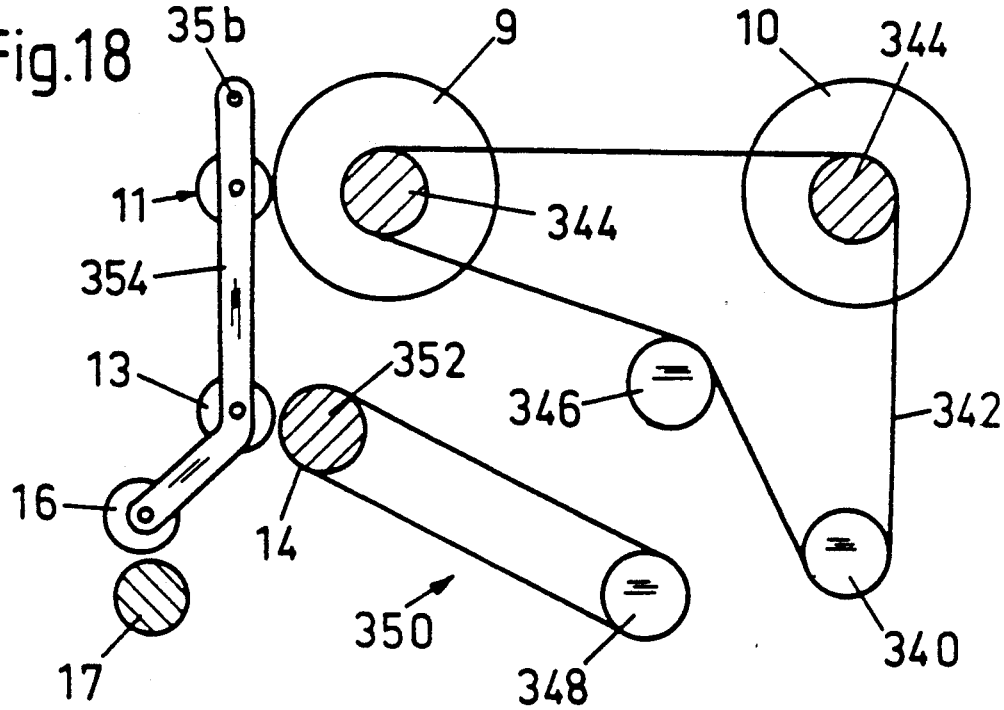
Figure 19:
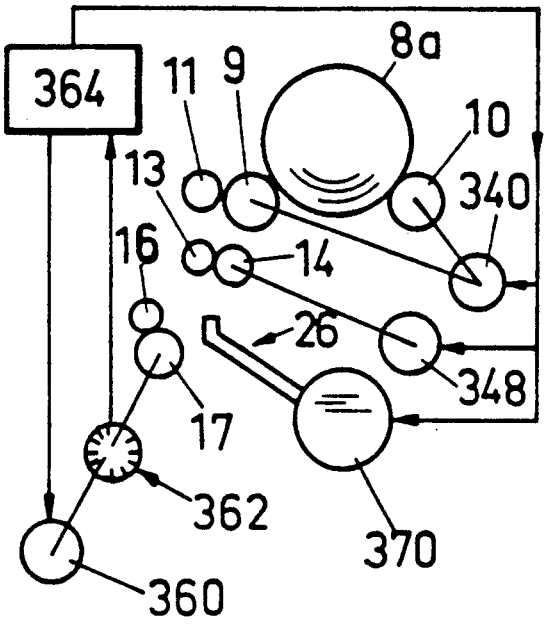
Figure 20:
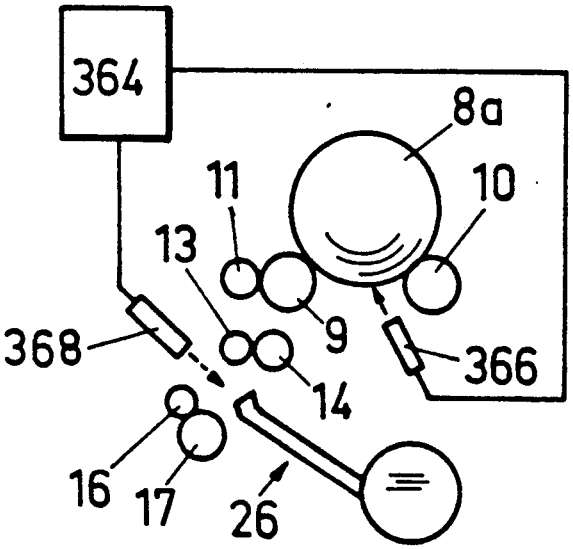
Figure 21:
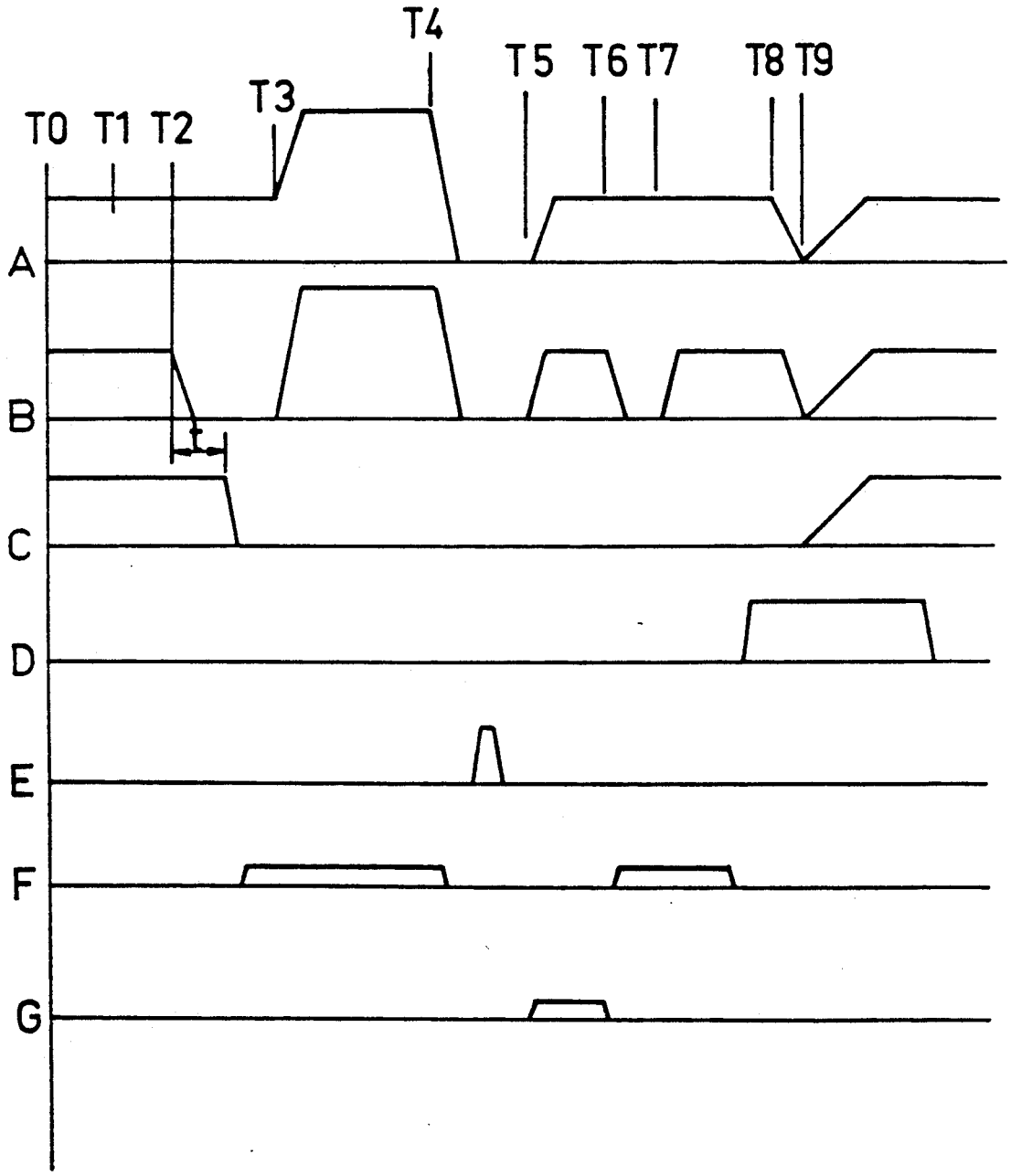
Figure 22:
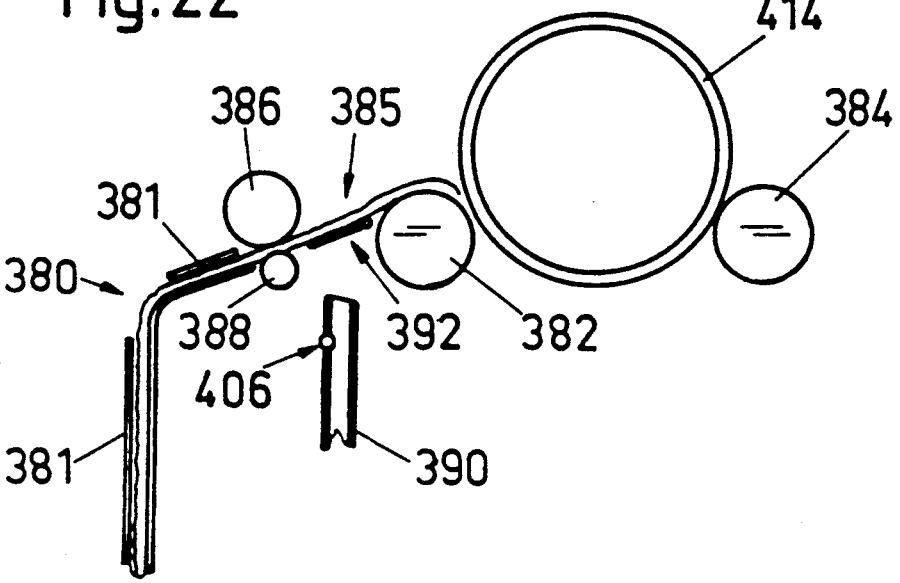
Figure 22A:
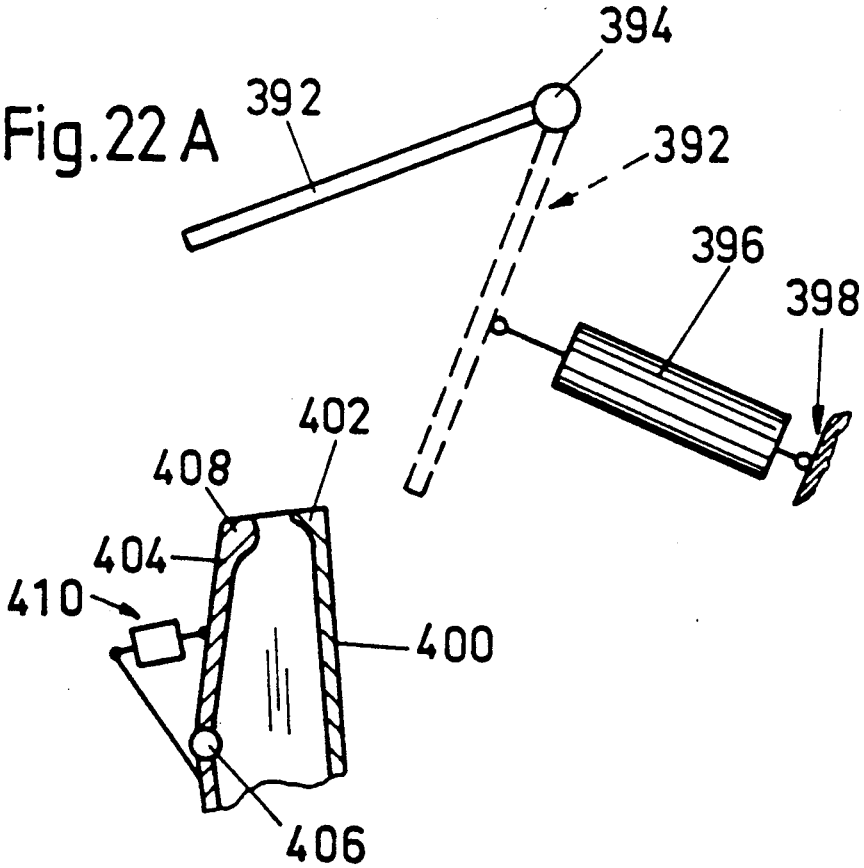
Figure 23:
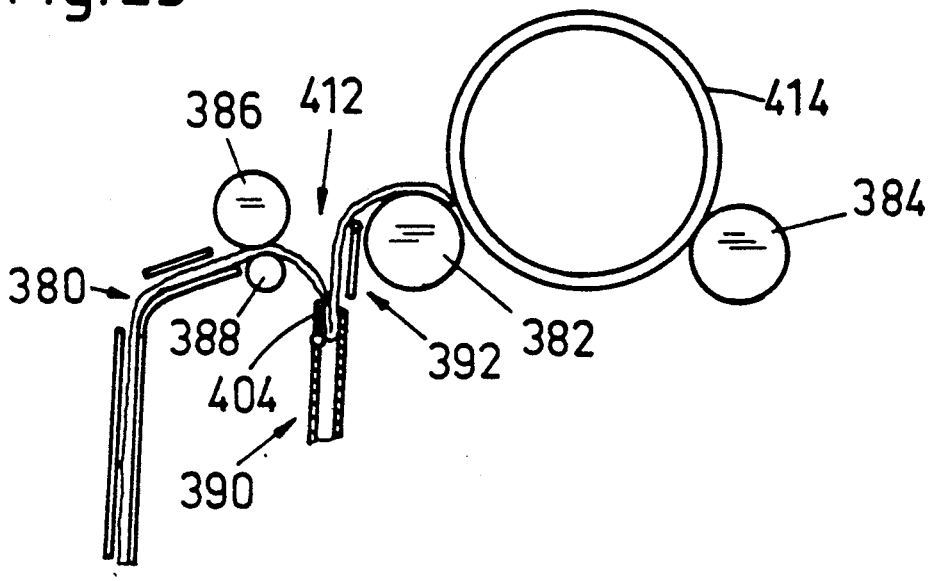
Figure 24:
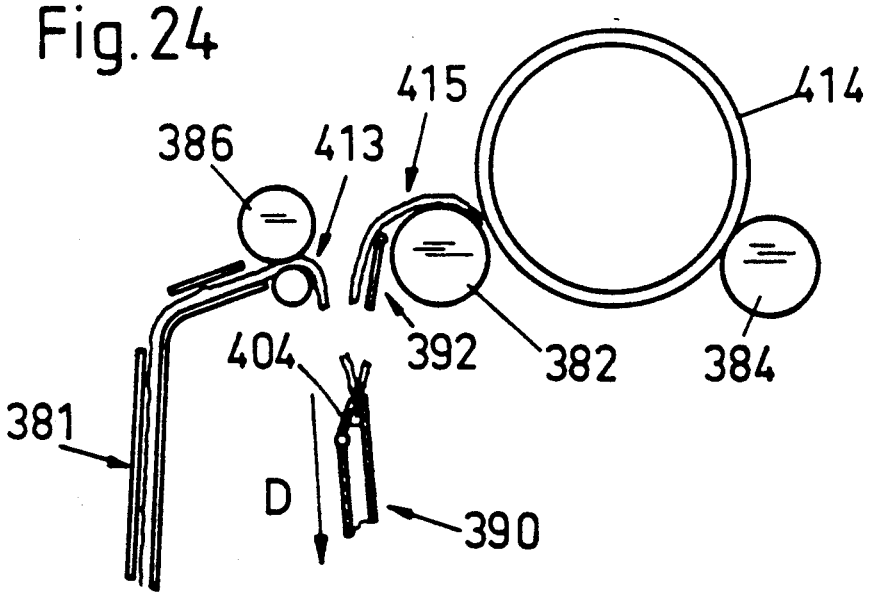
Figure 25:
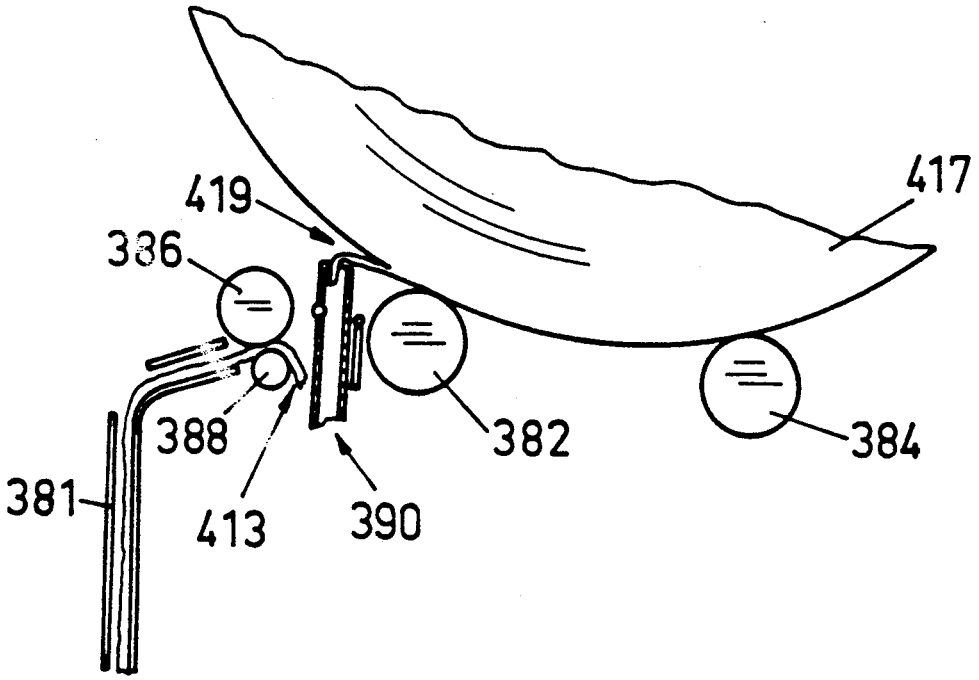
Figure 26:
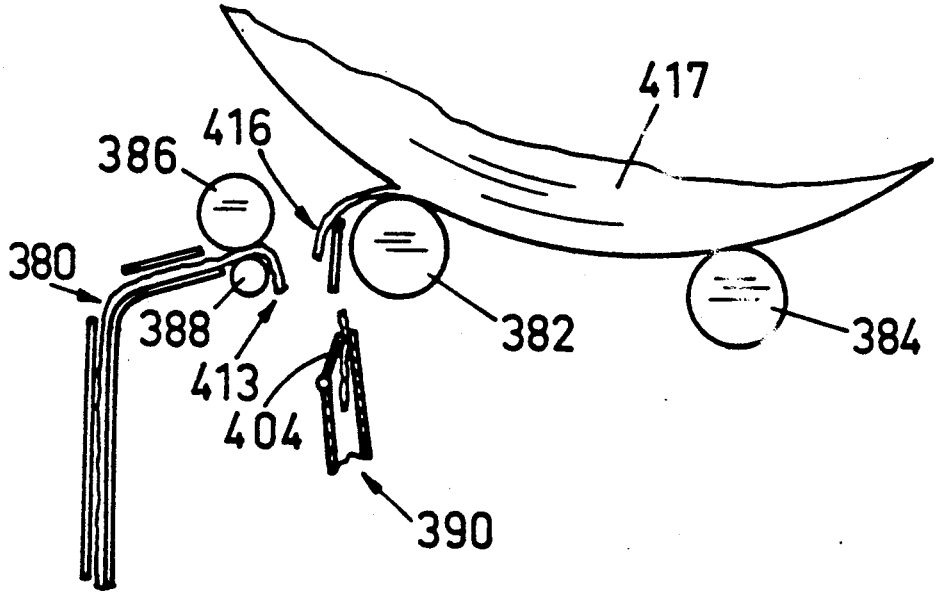
Figure 27:
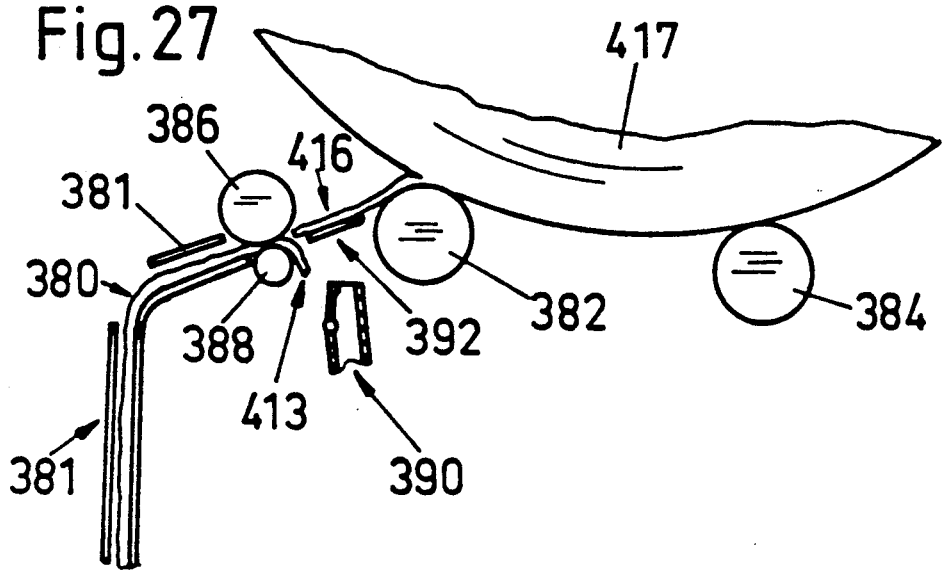
Figure 28:
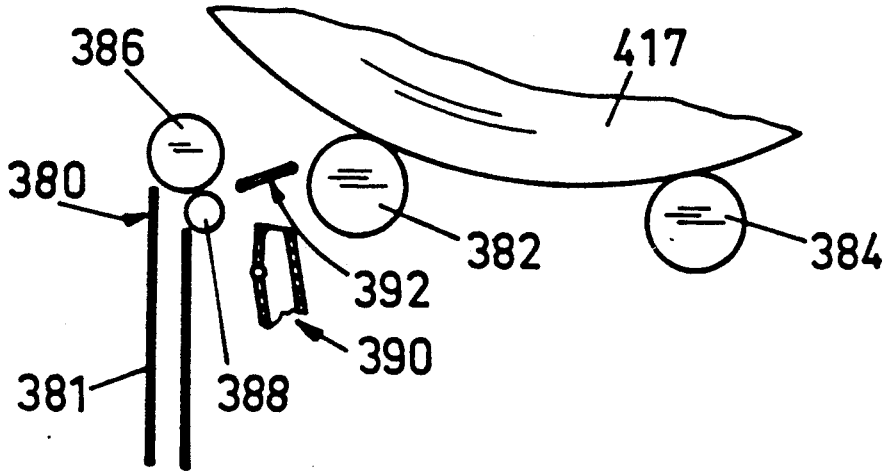
Figure 30:
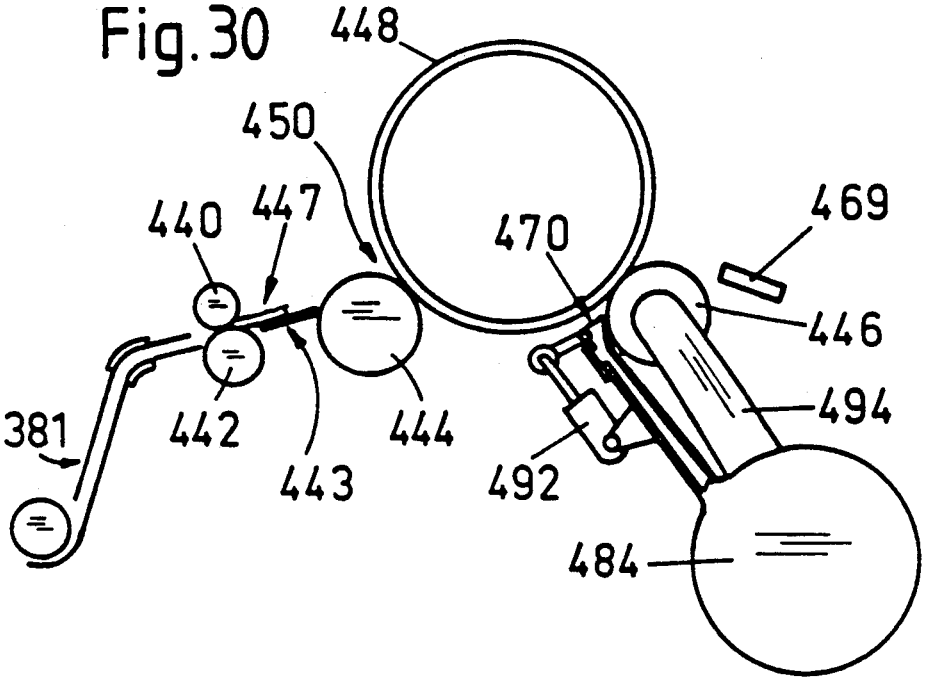
Figure 29:
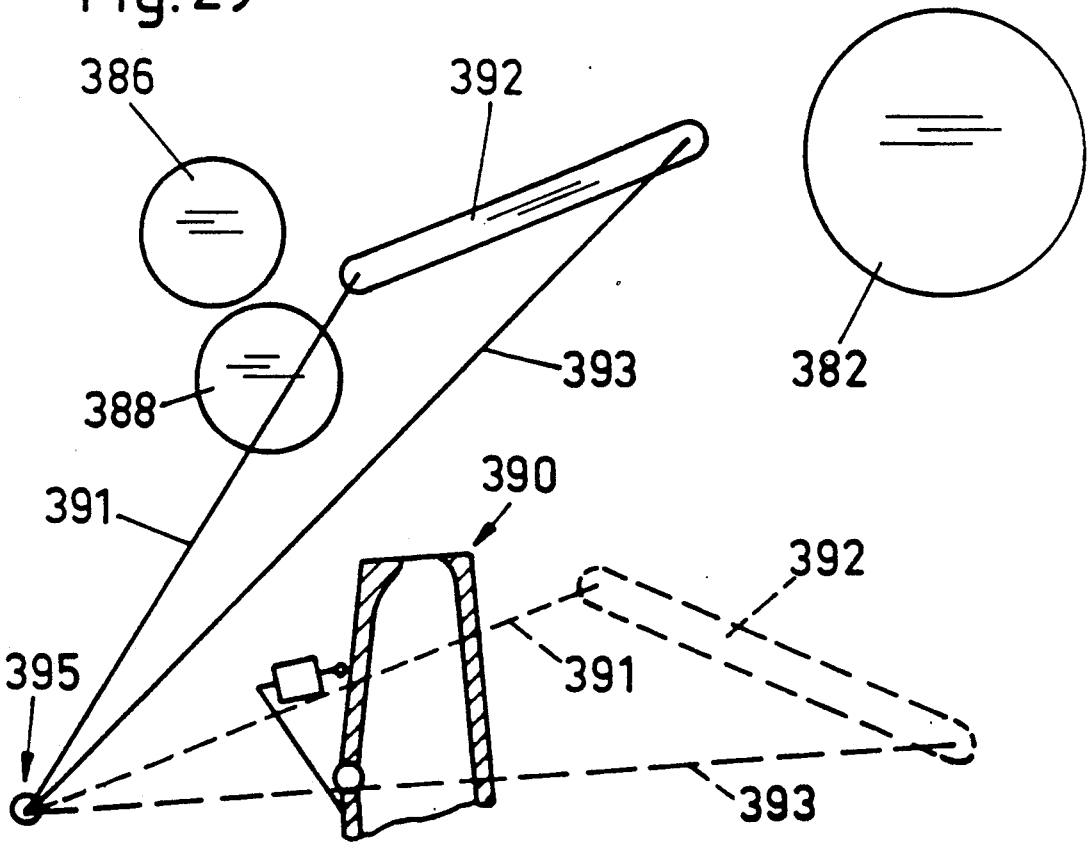
Figure 32:
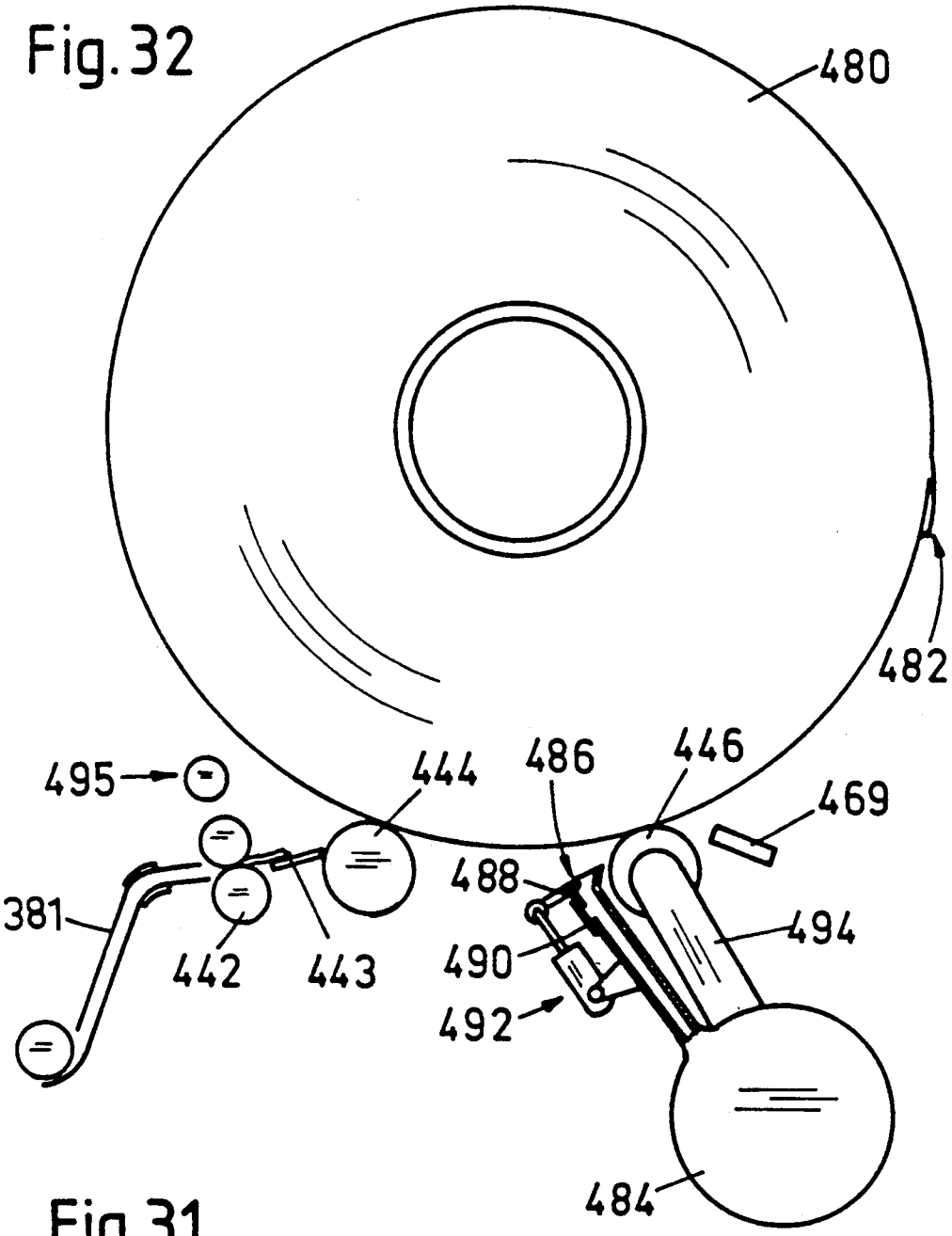
Figure 31:
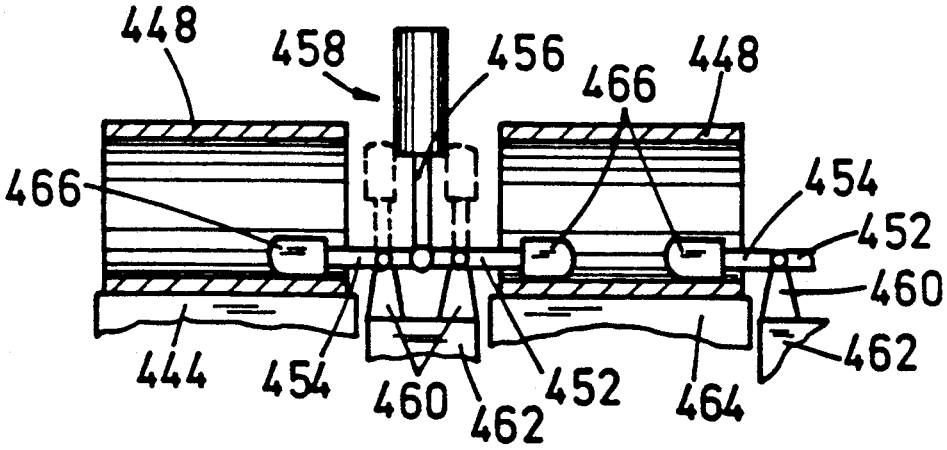
Figure 34:
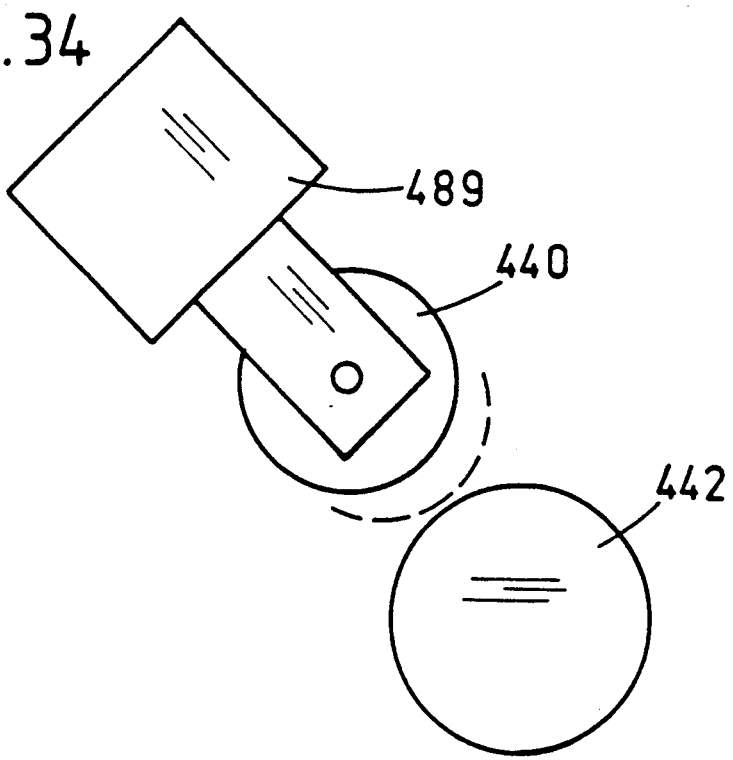
Figure 33:
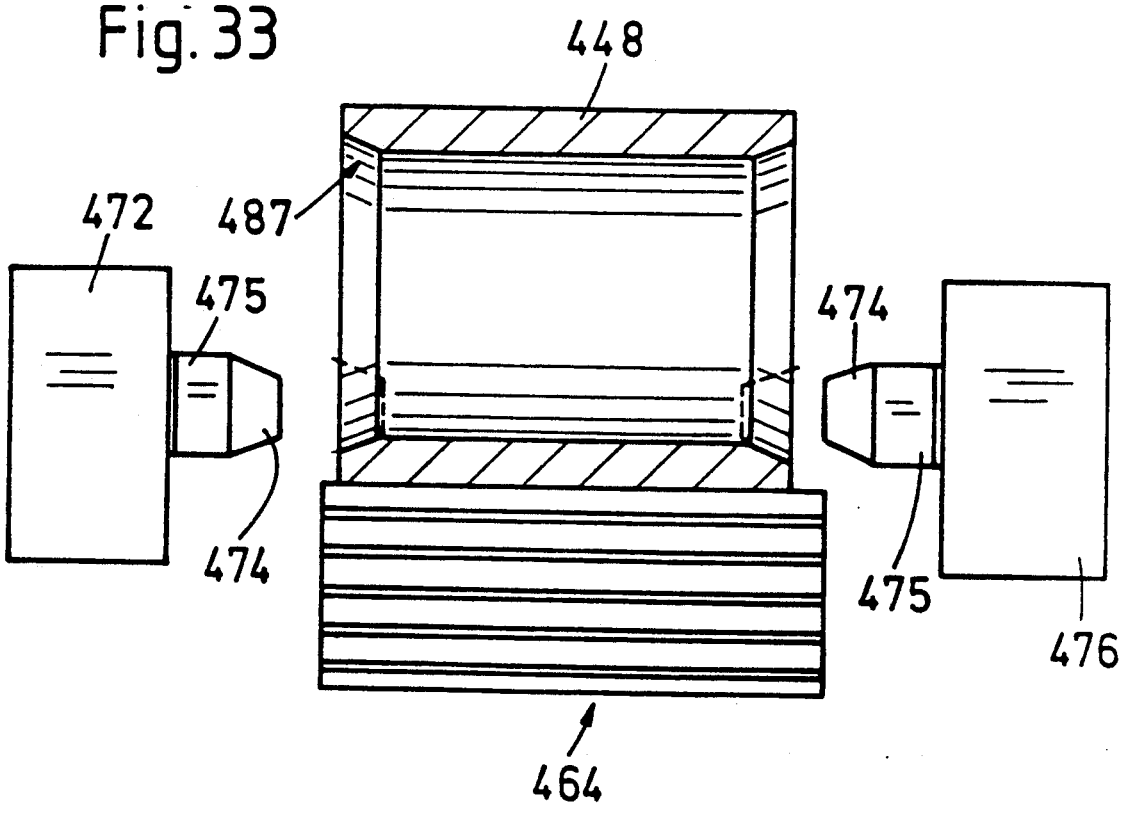
Figures 35, 36:
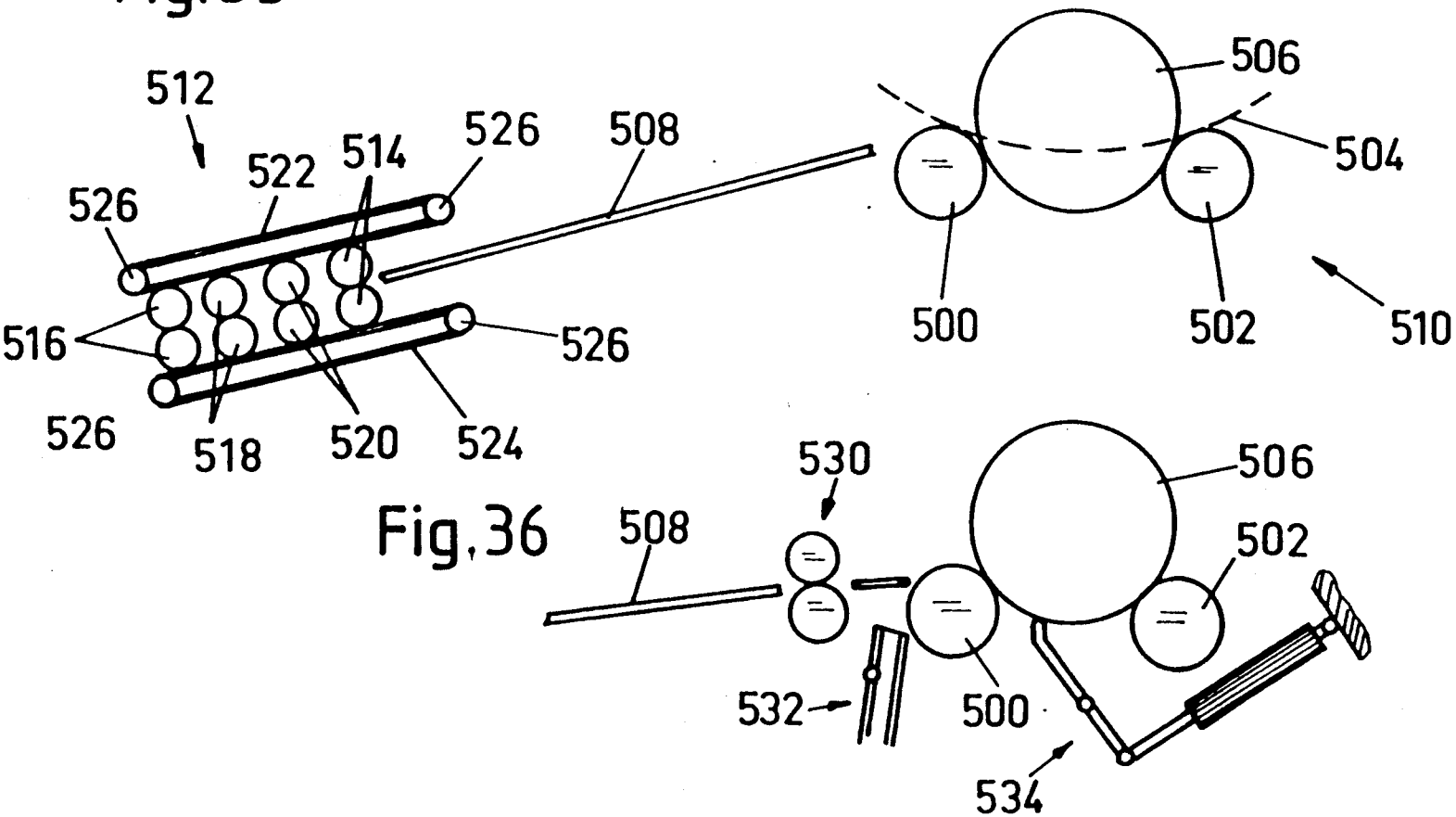

FIGS. 14 A, B and C show three possible modifications of the lap end finding arrangement shown in FIG. 1;

FIGS. 15 A and B show diagrams for explanation of the lap end preparation necessary, or at least highly desirable, for forming a piecing in accordance with the invention;

FIG. 16 is a diagram for explanation of a first possible arrangement for providing lap end preparation as shown in FIG. 15;

FIG. 17 is a diagram of an alternative arrangement for providing lap end preparation;

FIG. 18 is a schematic representation of a drive system for a device according to FIG. 1;

FIG. 19 diagrammatically illustrates elements of a control system for a driving arrangement in accordance with FIG. 18;

FIG. 20 shows the same system with different elements of the controlling means;

FIG. 21 illustrates a timing or a sequence diagram for use in explanation of the control system schematically illustrated in FIGS. 19 and 20;

FIG. 22 is a view similar to FIG. 1 of a simplified embodiment for use with the same type of combing machine as the arrangement shown in FIG. 1 in the normal operating condition;

FIG. 22A shows a detail taken from FIG. 22;

FIG. 23 is a diagram similar to FIG. 22 but showing the system in the first stage of end preparation for a subsequent piecing operation;

FIG. 24 shows the completion of the first end preparation step;

FIG. 25 shows the end finding procedure after a new lap roll has been put in place;

FIG. 26 shows the second end preparation step following finding of the new lap end;

FIG. 27 illustrates the piecing step in which the two prepared ends are brought together;

FIG. 28 illustrates a further modification of the arrangement shown in FIG. 22;

FIG. 29 shows a modification of the device shown in FIG. 22A;

FIGS. 30 and 31 illustrate a further embodiment in side view;

FIG. 32 shows a detail in front elevation;

FIG. 33 illustrates a pressing arrangement for a carrier in accordance with the invention;

FIG. 34 illustrates a further modified pressing arrangement for a carrier;

FIG. 35 diagrammatically illustrates a ribbon lap machine constructed in accordance with the invention; and FIG. 36 diagrammatically illustrates a modified ribbon lap machine in accordance with the invention.

Figure 8:
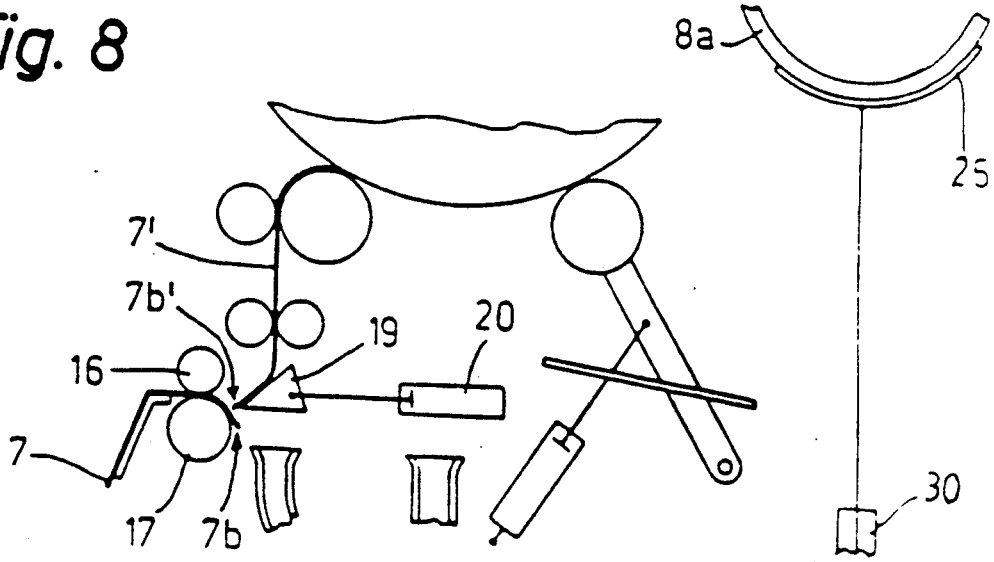
Figure 9:
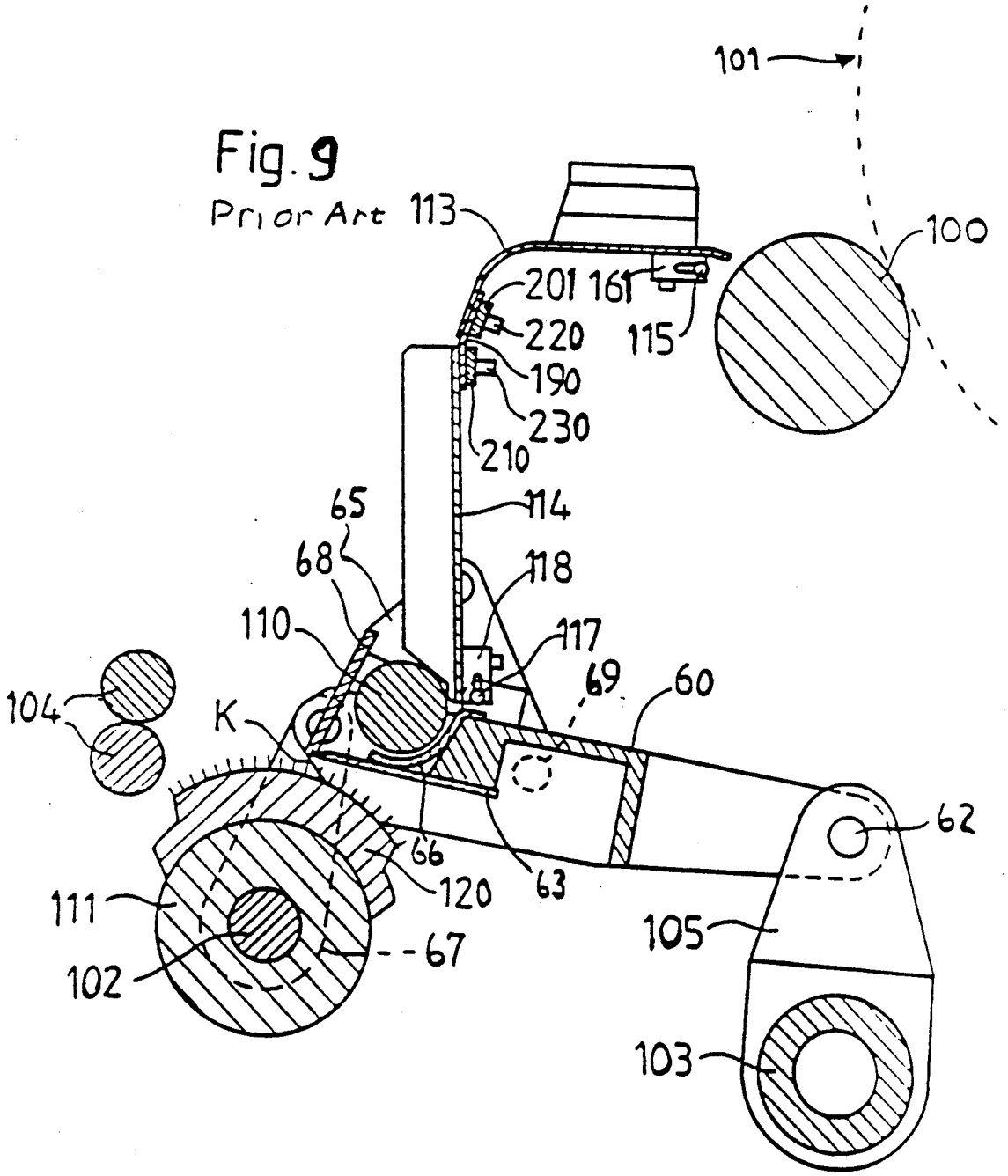
Fig. 9 Prior Art
Figure 10:
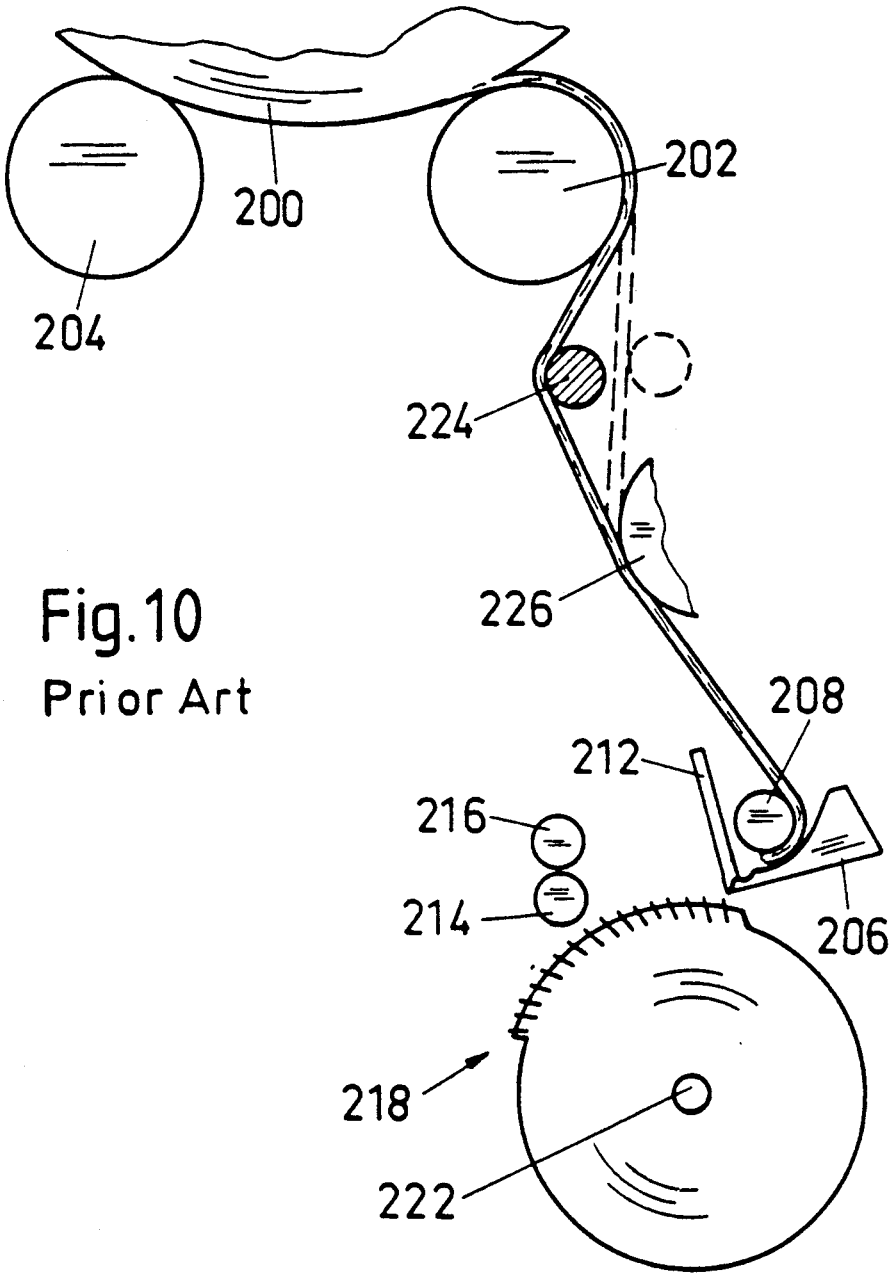
Fig.10 Prior Art

The present description will refer firstly to the "conventional" combing heads shown in FIGS. 9 and 10 in order to provide a basis for the subsequent illustration of various embodiments of the present invention. One such embodiment has already been shown in the prior application referred to above, and the drawings of that application are included again here as FIGS. 1 to 8 in order to give a starting point for the modifications shown in the other FIGS.

The various diagrams shown in this application illustrate only those elements of a combing machine important for the operation according to the present invention. Furthermore, only those operating steps are disclosed which have a direct connection with an operation according to this invention. A more complete description of a combing machine can be found, e.g., in the book "Drawing, Combing and Roving" by Zoltan S. Szaloki published by the Institute of Textile Technology, Charlotteville, Va., U.S.A., being volume 3 on "The Institute Series on Textile Processing" published by that Institute. The same publication further describes a ribbon lap machine to which the lap processing techniques can be applied.

Against this background, the combing head diagrammatically illustrated in FIG. 9 comprises a rotating lap carrier roll 100, a rotating drive shaft 102 for combing cylinder 111 carrying a needled half lap 120, a reversibly rotatable nipper drive shaft 103 and a pair of detaching rolls 104. The nipper drive shaft 103 carries a crank arm 105 to which the rear end of a nipper assembly 60 is pivotably connected at 62. The front end of the nipper assembly 60 is pivotably connected to links 67 which in turn can pivot around the axis of the drive shaft 102 for combing cylinder 111.

Nipper assembly 60 further comprises a bottom or cushion plate 63, the front end (not specifically indicated) of which is adapted to form a clamping nip K in co-operation with a correspondingly formed upper nipping element 68. Nipping element 68 is carried by a lever 65 hinged at 69 to the main structural element of the nipper assembly 60. A so-called feed roll 110 is located immediately behind the nipper pair 63, 68.

The lap processing elements thus far described in relation to FIG. 9 make up the essential working elements of the combing unit (lap processing unit) which performs the essential function of a combing machine. Since the combing operation itself is not directly involved in the present invention and details thereof are available in the literature (e.g. in the book referred to above) that operation will not be disclosed in detail herein. It is sufficient to state here that a lap or sheet of fiber material to be combed is forwarded (by a system to be described in somewhat greater detail hereinafter) to the feed roll 110 and thence in co-operation with a guide plate 66 to the nip K formed by the nipper jaws 63, 68. Fibers projecting from the nip are combed by the needles of the half lap 120 and are then passed by the nippers to be "pieced" with a fiber beard projecting from the rear of the detaching rollers 104.

After the nippers have deposited the newly combed fiber beard on the beard projecting from the detaching rollers, the nippers are opened and retracted while the newly combed fibers are withdrawn from the combing unit by the detaching rolls 104. At this stage, the fibers being drawn forward by the detaching rolls are further combed by a so-called top comb (not shown in FIG. 9). The nippers, meanwhile, are returned to the starting position shown in FIG. 9 and are closed to clamp a fiber fringe newly fed by the feed roll 110. As will readily be appreciated, this operation is essentially discontinuous, so that feed roll 110 is operated only intermittently.

The lap to be combed has a width of, e.g., 30 centimeters (cms) and is presented to the machine in a form of a roll partly indicated in dotted lines at 101 in FIG. 9. This roll of lap rests on two carrier rollers, only one of which is shown at 100 in FIG. 9. The second carrier roller is arranged parallel to the first and both are rotated so as to unwind the roll 101 in a sense tending to feed the lap continuously towards the combing unit already described above. In the feed system shown in FIG. 9, and described in European Patent Application No. 338 300, the lap unwound from roll 101 is passed first to a generally horizontal guide plate 113, and thence to a generally vertical guide plate 114 from which the lap passes to feed roll 110 and guide plate 66 already referred to.

Guide plates 113 and 114 are pivotably connected at 190 by a strip of flexible material secured to the respective plates by clamping bars 201, 210 and screws 220, 230. The other ends of the plates are joined to the machine frame (not shown) by suitable connecting means schematically illustrated at 115 and 117 respectively. The pivotal connections 115, 117 and 190 enable the plates 113 to adjust their positions relative to each other and to the machine frame in accordance with the reciprocating movement of the nipper assembly 60 as defined by the combing operation referred to above. By providing suitable guiding support for the lap between the lap roll carrier assembly (partly illustrated at 100) and the combing unit it is possible to feed lap continuously at a slow rate from the roll 101 although this lap is taken up and processed only intermittently in the combing unit.

It will be seen from FIG. 9 that the leading carrier roller 100 (i.e. the roller nearer to the combing unit) is set back from the combing unit so that a degree of horizontal travel of the lap is needed after it leaves the roll 100. This horizontal movement of the lap is guided by plate 113 until the lap reaches a position above the feed roll 110, whereupon the path of the lap turns approximately vertically downwardly, being guided by plate 114. This pattern of movement ("machine geometry") is not essential. An alternative is illustrated in FIG. 10.

The language used in U.S. Pat. No. 3,479,699 will be used here to describe the embodiment according to FIG. 10. Thus, a sliver lap 200 is carried in use by a pair of lap supporting shafts 202, 204 and is unrolled to be passed to a nipper assembly comprising a cushion plate 206, a fluted feed roll 208, and a nipper knife 212 cooperating with cushion plate 206 to form a nip. Detaching rolls 214, 216 take up the fibres after they have been combed by the half lap 218 driven on shaft 222. As shown in FIG. 10, the nipper assembly lies almost directly below the carrier roller 202, so that the lap moves generally straight down to the nippers.

The nipper assembly pivots pendulum-fashion about a nipper rock shaft, only partly illustrated at 226. An accumulator bar 224 moves back and forth between a position illustrated in full lines and a position indicated in dotted lines in synchronism with the movements of the nipper assembly and thereby absorbs slack in the lap arising from the continuous feed from the sliver lap 200 and intermittent take-up at feed roll 208.

The immediately following description will deal firstly with a proposal for automating an arrangement generally in accordance with FIG. 9. Thereafter modifications generally suitable for other combing systems will be disclosed.

FIG. 1 shows the essential parts of a combing head in a diagrammatic view corresponding roughly to a vertical section. The essential combing elements of the combing unit of the combing head are again shown in the form of a rotatable comb 1, a top comb 2, two detaching rollers 3 and a nipper unit comprising a lower nipper 4 and an upper nipper 5 pivotable with respect to the lower nipper. A drivable feed roller 6 is mounted in the lower nipper 4 and a lap 7 for combing is fed to it. The lap 7 comes from a roll 8 carried by a carrier means which, in the embodiment illustrated consists of two parallel lap rollers 9 and 10 on which the lap roll 8 bears.

In the path of the lap 7 from the roll 8 to the combing elements 1–5 there are disposed a pair of transport rollers, means for severing the lap and means for connecting a first lap end to a second lap end, the first lap end being a rear end of the lap running to the combing elements and the second lap end being a front end of a lap coming from a new lap roll, as will be explained in detail below.

In the embodiment illustrated, the transport roller pair is formed by the front lap roller 9 and a pressure roller 11 co- operating therewith. Alternatively, a transport roller pair separate from the front lap roller 9 could be provided for the lap coming from the roller 8. The transport roller pair 9, 11 is driven by a controlled drive means 12.

In the embodiment illustrated, the lap severing means are adapted to tear the lap after the transport roller pair 9, 11. To this end, a second transport roller pair 13, 14 is disposed after the first transport roller pair 9, 11 and is driven by a second controlled drive means 15. In normal operation of the combing machine, the two transport roller pairs 9, 11 and 13, 14 run at the same circumferential speeds. When a lap is to be separated or torn, the drive means 12 and 15 are so controlled as explained hereinafter that they rotate the two transport roller pairs 9, 11 and 13, 14 at different circumferential speeds and/or in different directions, so the lap 7 tears between the two transport roller pairs. Alternatively, the first transport roller pair 9, 11 may be stopped and the second 13, 14 may continue to be driven or else the first roller pair 9, 11 may be driven in the opposite direction while the second pair 13, 14 is stationary. In either case the lap is severed.

The means for connecting a first lap end to a second lap end comprises a pressing roller pair 16, 17 driven by a drive means 18, and a movable deflector element for at least one of two lap ends which are to be interconnected. In the embodiment illustrated, the deflector element is a slide 19 which is disposed upstream of the pressing roller pair 16, 17 in the direction of movement of the lap 7 and is moved, for example, by a piston and cylinder unit 20.

FIG. 1 shows the combing head as described in normal operation. The lap 7 is unwound from the roll 8 by rotation of the lap roller 9, is fed to the combing elements 1–5 by the pairs of transport rollers 13, 14 and 16, 17 rotating at the same circumferential speed, and is combed out by the combing elements. In FIG. 1, however, the lap 7 has already practically completely unwound from the roll 8. This time is detected by a detector means, e.g. a photo-electric cell 21, which detects the passage of the end 7*a* of the lap 7 on the core 8*a* of the roll 8, by responding, for example, to the different brightnesses and/or colors of the lap 7 and of the core 8*a*. Of course, other detector means are possible for this purpose.

The detector means 21 delivers a signal to a control means 22 which then so controls the drive means 12, 15 and 18 and other drive means to be described hereinafter, in the combing machine that a change of lap is performed automatically.

Figure 2:
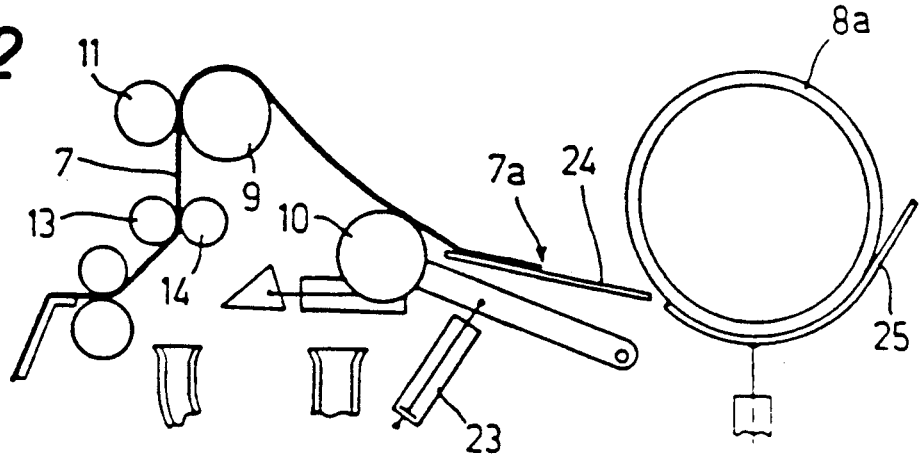

The control means 22 first actuates a piston and cylinder unit 23 which pivots the rear lap roller 10 away downwards as shown in FIG. 2. The almost empty core 8*a* therefore rolls by gravity rearwardly on a suitable guide 24 as far as a collector means in the form of a trough-shaped plate 25. The remaining lap is unwound from the core 8*a* in these conditions.

Figure 3:
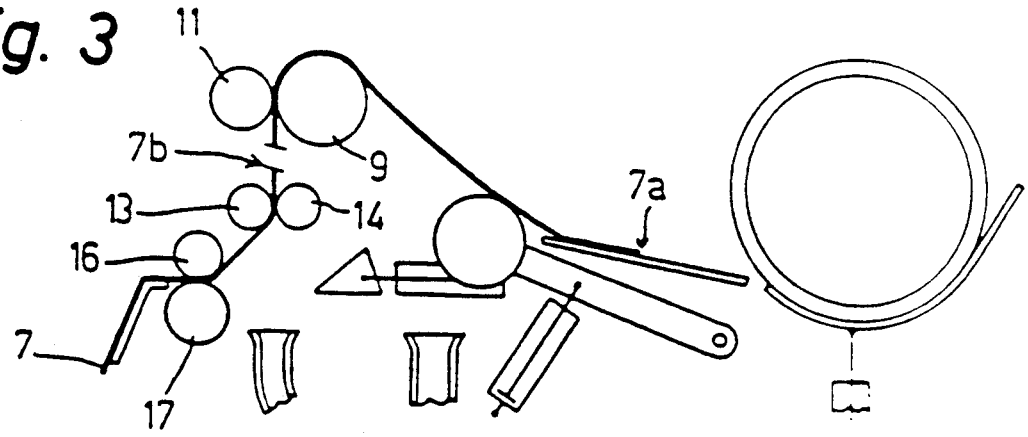

The control means 22 then controls the drive means 12 (FIG. 1) so that it stops the transport roller pair 9, 11 or rotates the same in the reverse direction. The lap 7 is therefore torn by the second transport roller pair 13, 14 as it continues to rotate normally, the tearing taking place between the two transport roller pairs 9, 11 and 13, 14, so that a new rear lap end 7*b* is formed at an accurately defined location on the lap 7 running to the combing elements 1–5, as shown in FIG. 3.

Figure 4:
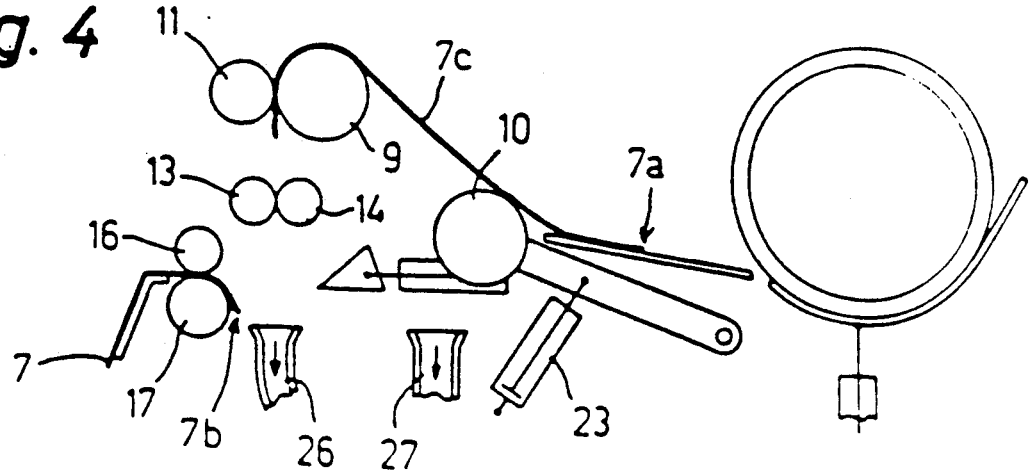

The second transport roller pair 13, 14 and the pressing roller pair 16, 17 continue to rotate until the newly formed rear lap end 7*b* stops just before the pressing roller pair 16, 17 as shown in FIG. 4. The drive means 18 of the pressing roller pair 16, 17 is then stopped and at the same time the combing elements 1–6 (FIG. 1) are also stopped.

When the first transport roller pair 9, 11 has simply been stopped to tear the lap 7, the severed rear end portion 7*c* of the lap 7 is still retained in the transport roller pair 9, 11 as shown in FIG. 4. The transport roller pair 9, 11 is therefore now rotated again in the forward direction together with the second transport roller pair 13, 14 to deliver the end portion 7*c* to a suction-extraction duct 26 by means of which it is removed. Alternatively, the end portion 7*c* may also be removed by a suction-extraction duct 27 disposed further to the rear, the first transport roller pair 9, 11 now being rotated in the reverse direction until the start of the end portion 7*c* drops into this suction-extraction duct 27. If, however, the first transport roller pair 9, 11 has already been rotated sufficiently in the reverse direction to tear the lap 7, the start of the end portion 7*c* can drop without difficulty into the duct 27 and no further rotation is required.

The rear lap roller 10 is then pivoted back into its top position or the normal working position by actuation of the piston and cylinder unit 23.

Figure 5:
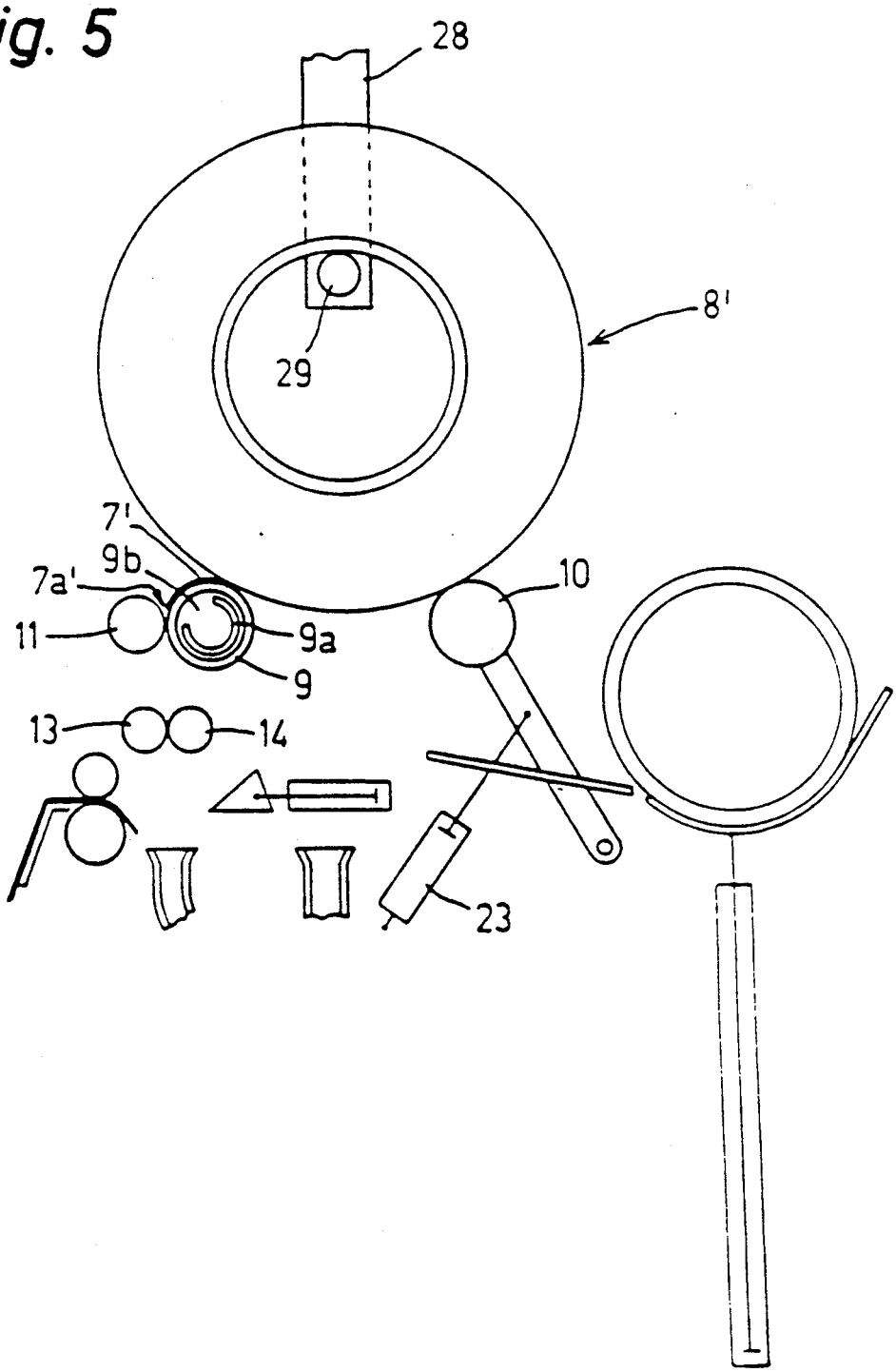

The control means 22 then actuates a lap roll transport device, of which FIG. 5 shows only an arm 28 with a supporting trunnion 29. The roll transport device brings up a new lap roll 8′ and places it on the lap rollers 9 and 10.

The transport roller pairs, 9, 11 and 13, 14 are then rotated in the forward direction. The lap roller 9 rotates the lap roll 8′ resting on it. The surface of the lap roller 9 is air-permeable, e.g. perforate, and a stationary tube 9*a* is disposed in its interior and has a slot 9*b* in a top zone. Suction is now produced in this tube 9*a* so that air is sucked through the slot 9*b* and the air-permeable surface of the lap roller 9. The start 7*a* of the lap 7′ from the new roll 8′ is therefore subjected to suction from the lap roller 9 as soon as it reaches the latter. Consequently, as shown in FIG. 5, the start 7*a* is applied to the circumference of the lap roller 9. The lap 7′ is then moved downwards by the transport roller pairs 9, 11 and 13, 14.

Figure 6:
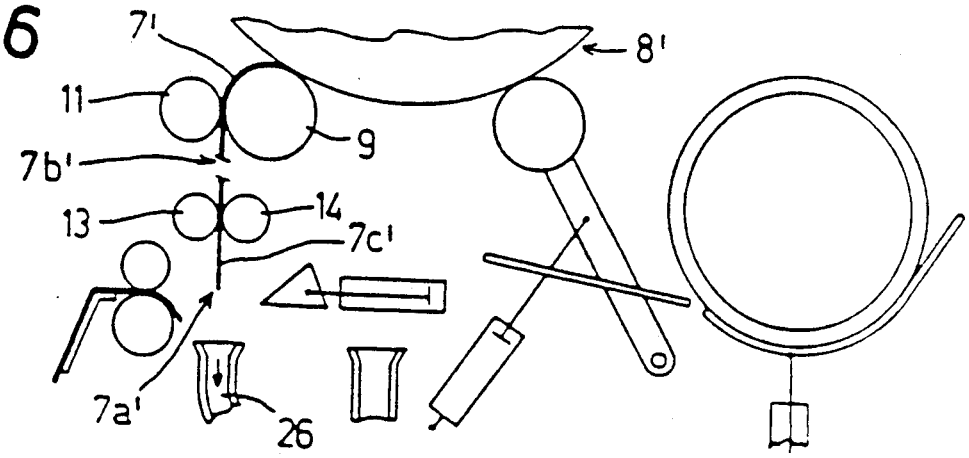

After the start 7*a* of the lap 7′ has passed through the second transport roller pair 13, 14, the first transport roller pair 9, 11 is stopped after a predetermined interval or else the second transport roller pair 13, 14 is accelerated with respect to the first pair 9, 11. As a result, the lap 7′ is torn between the two transport roller pairs 9, 11 and 13, 14, i.e., a new front lap end 7*b* is formed at an accurately defined location on the lap 7′ coming from the roll 8, as shown in FIG. 6.

The severed front end portion 7*c*′ of the lap 7′ is then sucked into the suction-extraction duct 26 and removed by the latter after passing completely through the second transport roller pair 13, 14.

The two transport roller pairs 9, 11 and 13, 14 then continue to run at the same circumferential speeds and move the lap 7′ downwards as it comes from the roll 8′.

Figure 7:
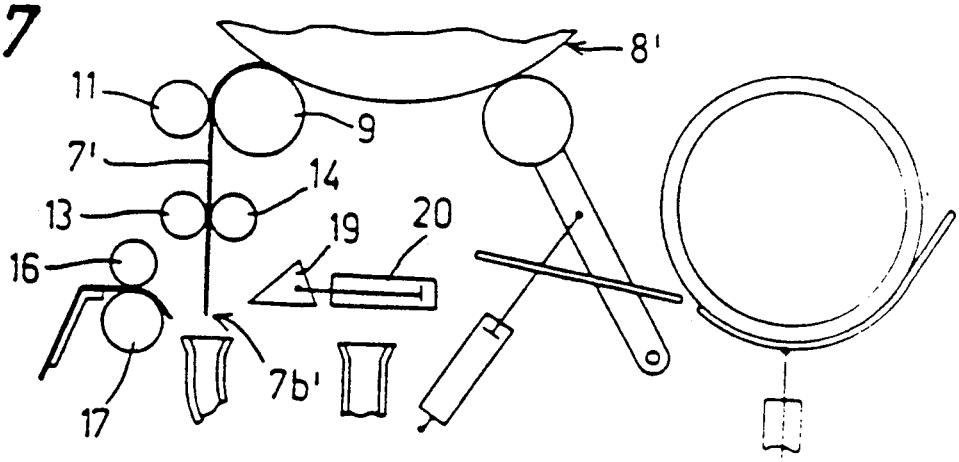

Once the new front lap end 7*b* has approximately reached the position shown in FIG. 7 in front of the pressing roller pair 16, 17 or between the latter and the slide 19, the control means 22 actuates the piston end cylinder unit 20 to move the slide 19 to the left against the pressing roller pair 16, 17. As shown in FIG. 8, in these conditions the slide 19 comes into contact with the front lap end 7*b*′ and places it on the rear lap end 7*b* of the lap 7 which is still held in the nip of the pressing roller pair 16, 17 and projects therefrom, resting partially on the circumference of the bottom pressing roller 17.

The drive means 18 for the pressing roller pair 16, 17 and at the same time the drive means for the combing elements 1–6 are then switched on again. The rear 7*b* of the lap 7 is pulled, together with the front end 7*b*′ of the new lap 7′ resting thereon, into the pressing roller pair 16, 17 which presses the two ends 7*b* and 7*b*′ together and joins them. In these conditions, the slide 19 is again pulled back to the right by the piston and cylinder unit. The combing head then resumes normal operation.

FIG. 8 also shows that the collecting means 25 with the empty roll core 8*a* lying thereon has been lifted into an upper position by a drive means in the form of a piston and cylinder unit 30. In this upper position, the empty roll core 8*a* is engaged and discharged by the roll transport means 28, 29 (FIG. 5), whereupon the collecting means 25 is again lowered into its starting position, as shown in FIG. 1.

The combing head described can be disposed in a combing machine in a group of combing heads in which combined drive means are provided for the combing elements 1–5 of all the combing heads of the group. The control means 22 is then associated jointly with all the combing heads of the group. The drive means controlled by the control means 22, more particularly the drive means 12, 15 and 18, and the piston and cylinder units 20, 23 and 30, together with the means for generating suction in the front lap roller 9 and in the suction-extraction ducts 26 and 27 and the roll transport means (28, 29) can also be associated jointly with all the combing heads of the group (although the common control means could in principle also control separate drive means).

On the other hand, each combing head of the group has its own associated detector means 21 (FIG. 1). As soon as the lap 7 has substantially completely unwound from the roll 8 at one of the combing heads, the associated detector means 21 delivers a signal to the common control means 22 which then simultaneously perform the above-described lap roll change at all the combing heads of the group. At the start of the lap roll change operation there may still be different lengths of lap 7 on the lap roll cores 8*a* in the various combing heads of the group; the new rear lap ends 7*b* formed by the simultaneous severing (tearing) of the lap slivers 7 between the transport roller pairs 9, 11 and 13, 14 are, however, then at the same height in all the combing heads of the group. Similarly, the new front lap ends 7*b*′, formed by tearing the new lap slivers 7′ are at the same height in all the combing heads even if the start 7*a*′ of the lap on the new lap rolls 8′ supplied by the lap roll transport means (28, 29) did not lie exactly at the same place on the circumference. The front lap ends 7*b* can therefore then be joined to the rear lap ends 7*b*′ without difficulty in the same way in all the combing heads by the slides 19 (or a common slide 19) and the pressing rollers 16, 17.

In the combing head described, on the change of lap, both the lap 7 and then the new lap 7′ are respectively severed or torn from the lap roll 8 and the new lap roll 8′ by differential drive of the two transport roller pairs 9, 11 and 13, 14. In modified embodiments, however, separate means could of course be provided for severing the lap 7 and for severing the lap 7′. Also, there is no absolute need for a second transport roller pair for severing purposes. Instead, other severing means adapted to be actuated by the control means 22 may be provided.

The prior application refers to tearing or severing of the lap. However, it is not desirable to produce either of two results, namely

- a ragged tear with deep indentations in the lap end to be joined, or
- a very clean cut with practically no fibres projecting beyond the cut surface (as though the sheet had been cut with scissors).

The preferred form of lap end is a fiber beard or fringe projecting from a substantially straight base line, which preferably extends at right angles to the length of the lap. The beard or fringe should be "thinned-out" relative to the normal thickness of the lap sheet. In this form, the two prepared ends approximate "combed" ends which are conventionally joined in a combing machine by a "piecing" at the detaching rolls. The lap piecing operation is then similar to the piecing of combed web as conventionally performed for example at rolls 104 (FIG. 9) or 214, 216 (FIG. 10).

This form of prepared end can be best generated by applying a clamping force to the lap along a straight line (similar to the clamping force applied by the nipping elements) while removing fibers not held either directly by the clamping force or indirectly by the sheet of fibers. The clamping force is preferably evenly distributed along the length of the clamping line, i.e. preferably across the width of the lap.

The desired result can be achieved by clamping between a pair of rolls and drawing the lap apart in the region of the clamping nip (as described with reference to FIGS. 1 to 8) by means of a second pair of rolls. The distance between the clamping nips should be at least slightly greater than the longest fiber in the assembly. This distance may be several centimeters longer than the longest fiber in the lap. This procedure forms two "prepared ends, i.e. upstream and downstream from the "tear" or "break", although only one of these ends will be of interest for forming a join.

A similar result could be obtained by clamping the lap along a first line (for example between a pair of nippers), clamping the lap along a second line (for example by another pair of nippers) and then moving the clamping lines apart. The distance between the clamping lines should satisfy the requirements already described in relation to the nip lines of the draw roll pairs. This procedure will also form two prepared ends.

The desired form of end preparation is shown diagrammatically in FIGS. 15A and 15B. FIG. 15A shows a plan view of a prepared en of a lap, while FIG. 15B shows the same lap end viewed from one side and drawn to a much larger scale.

The lap of width W, and thickness T unrolled from the lap roll is indicated at 250 in FIGS. 15A and 15B. The line N in FIG. 15A represents the nip or clamping line generated for example by the pair of rolls 9, 11 in FIG. 1. FIG. 15A shows the preferred arrangement in which the nip line is disposed at right angles to the length of the lap. The nip line could be disposed at another angle to the length of the lap (for example as illustrated in dotted lines), but significant deviations from the right angle relationship will complicate the joining procedure. However, an angle other than 90° could help to further reduce quality deterioration at the join.

The nip line N is indicated in FIG. 15B by the pair of arrows N indicated in that Fig. As shown in FIG. 15B, the preferred lap end is then in the form of a thinned out fiber beard or fiber fringe 252 projecting from the nip line where the lap has substantially the same thickness as in the roll (the compression applied by the clamping elements is ignored for the purpose of this explanation—the lap "thickness" is taken as directly proportional to the mass of fiber per unit length of lap).

In the theoretically perfect join between the lap ends (outgoing and incoming), the thinned out ends when superposed will compensate each other to give a new feed lap of substantially constant "thickness" (fiber mass per unit length) for feeding to the nipper assembly. This can be easily visualized in relation to FIG. 15B which shows the gradual reduction in fiber mass per unit length from the nip line to the free lap end.

However, consideration of FIG. 15A will show that it is virtually impossible to achieve an absolutely perfect join over the full width of the lap. The variability of the prepared lap ends therefore has to be held within acceptable limits in order to achieve an acceptable join. The absolute limits are given on the one hand by blockage of the combing assembly and on the other hand by a "thin place" such that the lap breaks before reaching the combing assembly or in that assembly.

In order to enable a "quality piecing", the length L (FIG. 15B) of the prepared end must be substantially predetermined. A "ragged" end (indicated by dotted lines 254 in FIG. 15A) will be undesirable because it is most unlikely that this ragged end will "match" an equally ragged end on the other lap involved in the joining operation. It will not be possible to ensure an absolutely constant length L of the prepared lap end across the whole width W of the lap. This effect is indicated diagrammatically by the lines ("fibers") projecting from the nip in FIG. 15A. The effect arises, for example, because of differences in the lengths of the fibers clamped at the nip line and therefor held fast during the severing operation.

The length of the lap end may, however, be influenced by the way in which the prepared lap end is formed, as will now be explained by reference to FIGS. 16 and 17.

FIG. 16 shows a severing (and end preparing) means in the form of two pairs of nip rolls 256, 258 with the lap 250 still extending continuously between them (before the severing operation). The distance D between the nip lines created by these roll pairs will exert an influence on the lap ends created by holding nip rolls 256 stationary and driving the roll pair 258 in the direction of the arrows marked thereon. This distance D should be at least slightly greater than the length of the longest fiber in the sheet of fibers to be severed. This ensures avoidance of "gripping", which would lead to fiber breakage or at least running defects.

However, the distance D should not be made much longer than the longest fiber because otherwise packets of uncontrolled or imperfectly controlled fibers can be formed, leading to the ragged end problem indicated in FIG. 15A. The arrangement should be such that substantially all fibers in the sheet extending between the roll pairs 256, 258 at the time of stopping of roll pair 256 either remain firmly controlled by the fiber beard projecting from roll pair 256 or pass cleanly into the fiber beard drawn out by roll pair 258. Those fibers clamped in the nips of roll pairs 256, 258 will not cause any problems (provided they are not clamped in both nips)—the remaining "swimming" (shorter) fibers between the nips will be subjected to a drafting force during the severing operation, but should remain under control due to the frictional engagement with their neighbors in the fiber sheet as the lap is drawn apart (due to the "force fields" created in the fiber sheets by the nips). An operation of this type gives two properly prepared ends (upstream and downstream).

In a short staple combing machine, the longest fiber in the sheet of fibers to be processed will normally have a fully extended length not greater than about 45 millimeters (mm). The distance D should normally be chosen in the range 60 mm to 120 mm, the preferred distance being 90 millimeters (mm). This will give fiber beard lengths L in the range 20 mm to 60 mm, the preferred length L being about 40 millimeters (mm).

FIG. 17 shows an alternative arrangement. The sheet 250 of fibers is clamped between nipper jaws 260, 262 (for example, similar to the nipper jaws of the combing unit). If the sheet 250 extends to a nip roll pair (similar to roll pair 258) downstream (to the right) of nippers 260, then the relevant considerations regarding spacing of the nip lines are the same as those explained for FIG. 16, and they will remain the same if that downstream roll pair is replaced by a second pair of nipper jaws similar to the nippers 260, 262.

A severing (and end preparing) operation could, however, be performed on the sheet 250 to the right of nipper jaws 260, 262 by inserting (for example) a straight comb 264 into the sheet to the right of the nip line and combing out the fiber beard clamped in the nip. Such an operation could be used, for example, to prepare the end of an incoming lap. In order to ensure a controlled lap end, the comb 264 must be inserted into the lap at a distance from the nip line such that the fibers remaining in the fiber beard are either clamped in the nip or controlled by engagement with other fibers in the sheet (by the "force field" created by the nip). The same effect can be obtained by exerting a very strong suction force on a sheet end projecting from the nippers 260, 262 (for example by means of a suction nozzle diagrammatically indicated in dotted lines at 266) or by processing the lap end with a rotary comb indicated at 265. Such an operation gives only one prepared end. An arrangement as described with reference to FIG. 17 has been used as the basis of the embodiment shown in FIG. 11, representing a modification of the conventional arrangement shown in FIG. 10.

Figure 11:
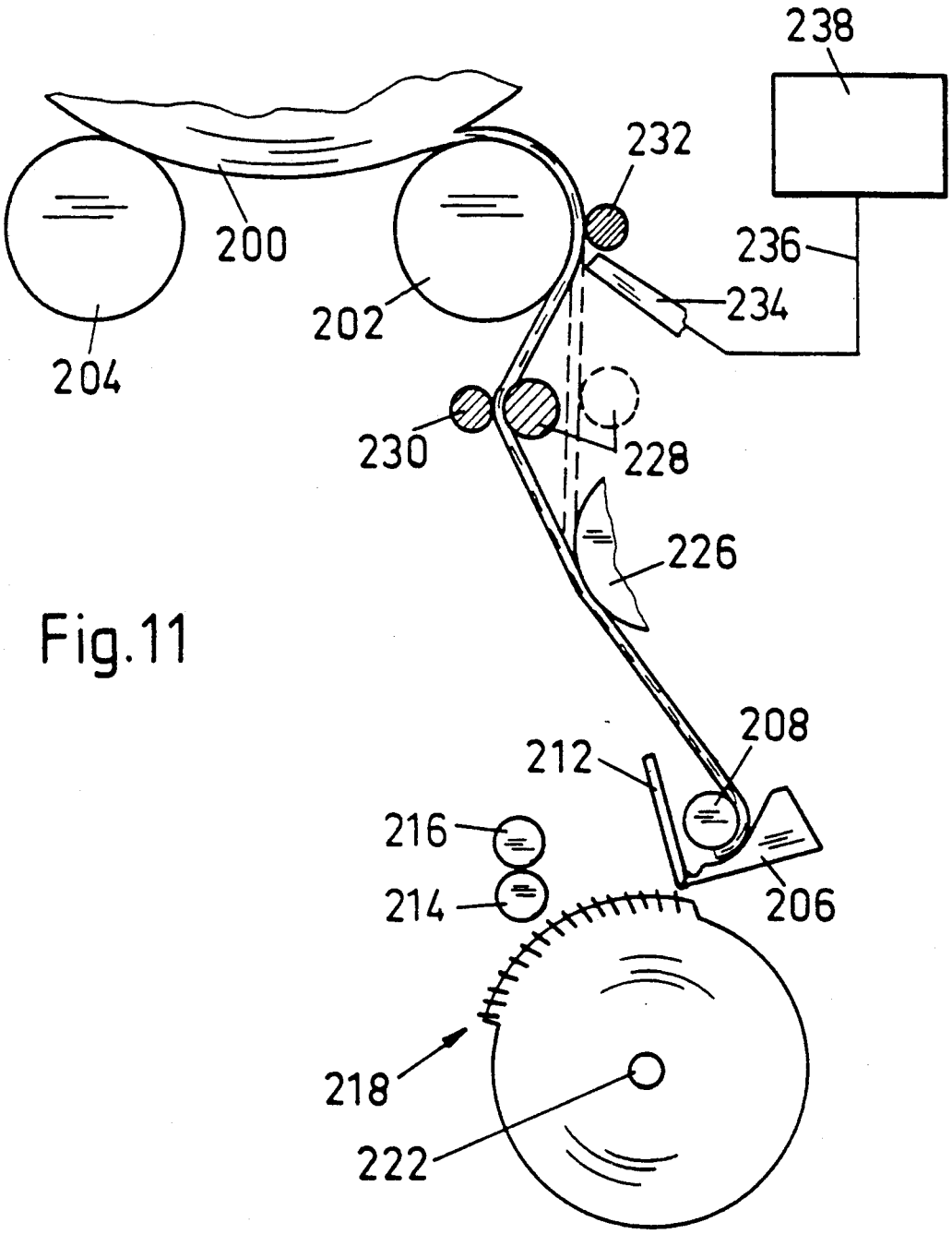
FIG. 11 is a diagram of a combing head as shown in FIG. 10 with modifications according to the invention.

As shown in FIG. 11 the "accumulator bar" (224 in FIG. 10) is replaced in the modified embodiment by a pair of transport rolls 228, 230 and a pressure roll 232 (similar to the pressure roll 11 in FIG. 1) is associated with lap carrier roller 202. A suction nozzle 234, is connected by a flexible lead 236 to a suction (vacuum) source 238. The suction nozzle is movable between a withdrawn position (not shown) and an advanced position (FIG. 11) in which the suction effect exerted by the nozzle acts on the lap immediately downstream from the nip created by the roller 202 and the pressure roll 232.

The device operates as follows:

First, a prepared end is formed on the outgoing lap by stopping roller 202 while driving rolls 228, 230, so that the lap is drawn apart as described above with reference to FIG. 16 just downstream of the nip line formed by roller 202 with pressure roll 232.

As already described, this will give an upstream prepared end (on the lap extending back to the roll 202) and a downstream prepared end (on the "trailing" end of the length of lap extending to the nipping elements). The prepared trailing end of the latter is held just upstream from the nip line of the roll pair 228, 230 (as already described with reference to the rolls 16, 17 in FIG. 1). The severed length of lap with the prepared end thereon is held firmly supported between roll pair 228, 230 and the combing unit (feed roll 208 end cushion plate 206).

Next, the remaining lap on the old roll is removed by any suitable means (for example, only, by feeding the lap forward into the suction nozzle 234 which has been moved to its operative position shown in FIG. 11). The expired roll is then replaced by a new roll, e.g. as described with reference to FIG. 5.

Then, a prepared end is formed on the new lap by feeding the lap into the nip formed by roller 202 and pressure roll 232 and then applying suction from nozzle 234 to the lap end exposed from the nip, thereby carrying away any fibers not firmly held by the nip or the force field generated thereby (as described with reference to FIG. 17).

The prepared leading end on the new lap is then moved straight down until the end lies on the prepared end previously formed on the old lap still "threaded" with the rolls 228, 230 and the nipper assembly. To enable this, the roll pair 228 is preferably located in the dotted line position shown in FIG. 11—it is then unnecessary to provide for diversion of the prepared lap end from its movement straight downwards. If roll pair 228, 230 is in the position indicated in full lines, diversion of the lap end from the straight downward path may be needed to lay the end of the new lap on the prepared end of the old one.

The join is formed as described with reference to FIG. 1 by restarting the feed at all points along the path from the carrier roller 202 to the feed roll 208, the superposed lap ends being pressed together in this case by the rolls 228, 230.

It will be clear that, the pressure roll 232 shown in FIG. 11 could be replaced by a clamping bar laid against the stationary carrier roller 202 to form a nip.

In comparing the arrangement shown in FIG. 11 with that shown in FIG. 1, the following can be noted:

The arrangement shown in FIG. 11 does not require a deflector element (similar to the elements 19, 20 in FIG. 1) because the downward movement of the incoming lap carries the prepared end of that lap onto the previously prepared end of the outgoing lap.

The arrangement shown in FIG. 11 does not require an additional pair of rolls similar to the rolls 13, 14 in FIG. 1 because the second end preparation step (on the incoming lap) is performed by the suction device 234 in conjunction with a nip formed on the carrier roller 202.

The arrangement according to FIG. 1 has two advantages:

First, the basic arrangement of a machine as illustrated in FIG. 9 remains unaffected (the roll pair 16, 17 delivers lap horizontally onto the plate 113 FIG. 9 or its equivalent), and the elements required to perform the piecing operation can be added to the existing machine in the form of a "superstructure". This is, of course, no longer essential if a new machine design can be taken into consideration.

Second, the end preparation provided by drawing the lap apart by means of roll pairs (16, 17; 13, 14; 11, 9) is likely to be better than that obtainable from a suction device such as nozzle 234 (FIG. 11).

FIG. 11 does show that the first end preparation step (on the outgoing lap) can be performed by the roll pair subsequently used to press the lap ends together (the "joining" or "pressing" rolls 16, 17 in FIG. 1). Thus, in the arrangement of FIG. 1, the outgoing lap end can be prepared by nipping the lap at the roll pair 13, 14 and operating roll pair 16, 17 to draw the lap apart between these roll pairs (compare FIG. 3). This may simplify the task of locating the prepared end on the upstream side of the nip of roll pair 16, 17 to receive the prepared end of the incoming lap. However, it may also complicate the overall drive system, as will subsequently be explained with reference to FIG. 18.

After performing this first end preparation step, roll pair 16, 17 must be held stationary in order to locate the length of outgoing lap extending from this roll pair to the nipper assembly. This roll pair (the "pressing" or "joining" rolls) therefore cannot participate in the second end preparation step (on the incoming lap). Hence, if it is desired to use a roll pair to draw the lap apart in the second end preparation step, an additional roll pair 13, 14 must be provided. Furthermore, if the width of the machine cannot be increased, then this additional roll pair has to be located above the roll pair 16, 17 (as shown in FIG. 1) thereby necessitating the deflector element 19, 20 in order to place the downwardly moving incoming lap onto the prepared end of the outgoing lap held by the roll pair 16, 17 delivering lap horizontally.

In the light of these remarks, several further possible modifications of the arrangement shown in FIG. 9 will be readily understandable, namely:

First, if the machine can be widened, then the incoming lap can be fed horizontally from the roller 9 to the roll pair 16, 17. However, the lap end cannot be made to move reliably in a horizontal direction without a moving means provided specifically for this purpose. A clamping nip of the type shown in FIG. 17 could, for example, by formed as a "swinging nip" (similar to the nippers in the combing unit). The swinging nip would move generally horizontally in order to bring the prepared ends together. This is unlikely to be a desirable alternative, but it is possible, Second, the roll pair 16, 17 could be provided at the region of the junction of plates 113, 114 (FIG. 9) instead of at the infeed to plate 113 (as diagrammatically illustrated in FIG. 1). The other clamping nip could then be provided at infeed to plate 113. In this case also, means would be required to "carry" the prepared end of the incoming lap over the horizontal path from the upstream nip to roll pair 16, 17, Third, the roll pair 13, 14 could be eliminated and a suction nozzle (similar to the nozzle 234 in FIG. 11) or comb could be used to prepare the end of the incoming lap held at the nip formed by carrier roller 9 and pressure roll 11 (FIG. 1).

A practical difficulty may arise where it is necessary to transmit drive to an element which is not fixed relative to the machine frame during normal operation (e.g., the roll 228 in FIG. 11). It is, however, possible to form the clamping nip only at the time of performing a lap piecing operation by moving the second roll of the pair (roll 230) from a withdrawn position into engagement with the guiding roll (228) in response to a signal that lap piecing is required. Drive can be applied to the second roll and can be transmitted by friction to the guide roll (228) which is merely supported for free rotation about its own axis.

During normal operation, when the drive roll (roll 230) is returned to its withdrawn position, the guide roll (228) is free to swing as required by the normal machine operation. Drive contact of the drive roll with the guide roll can be broken off as soon as the joined lap ends have passed through the nip formed between the joining or pressing rolls.

Figure 12:
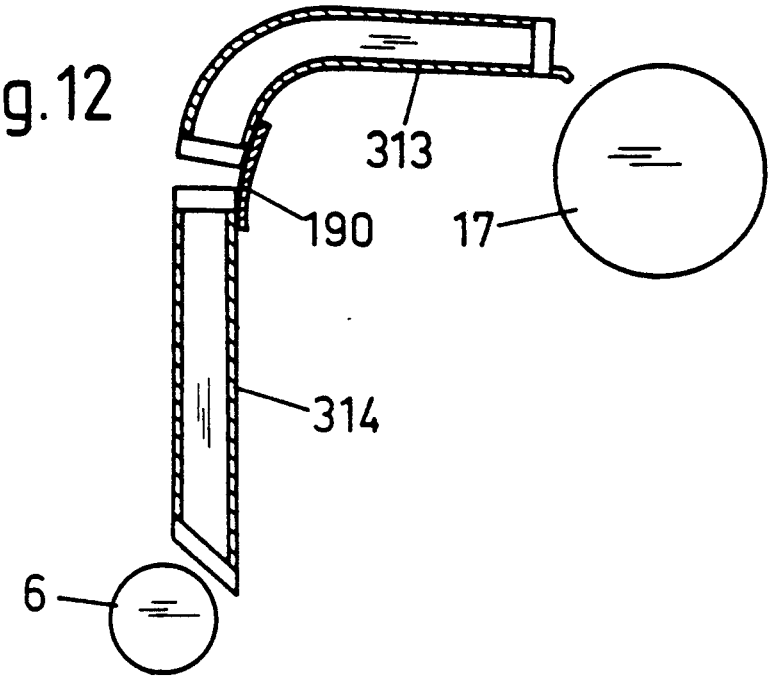
FIG. 12 is a diagram of a first modification of the device shown in FIGS. 1 to 8.

In all embodiments, it is desirable to provide a "channel" through which the joined ends have to pass to the feed roll (110, FIG. 9; 208, FIG. 10) after leaving the pair of joining rolls. The "channel" should provide guide faces directed towards both major surfaces of the lap. A suitable channel can be formed by modifying the plates 113, 114 (FIG. 9), e.g. as shown by plates 313, 314 (FIG. 12). This (partial) "enclosure" of the joined ends as they travel to the feed roll reduces the risk of drawing apart of the (relatively) weak join region of the sheet of fibers.

Figure 13:
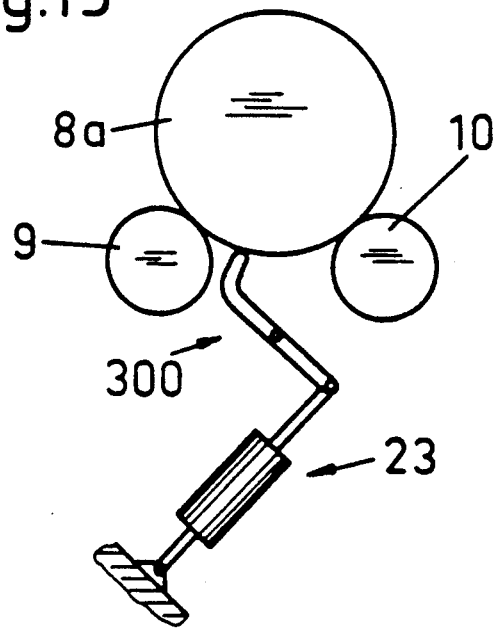
FIG. 13 shows a further possible modification of the device shown in FIGS. 1 to 8.

FIG. 13 illustrates a modification of the lap roll carrier. In this case, the axis of the roller 10 (FIG. 1) is fixed relative to the machine frame and a pusher 300 is provided to push the expired roll core 8*a* out of the carrier unit. Piston and cylinder unit 23 acts in this case on the pusher 300 instead of on the support for carrier roller 10.

Figure 14C:
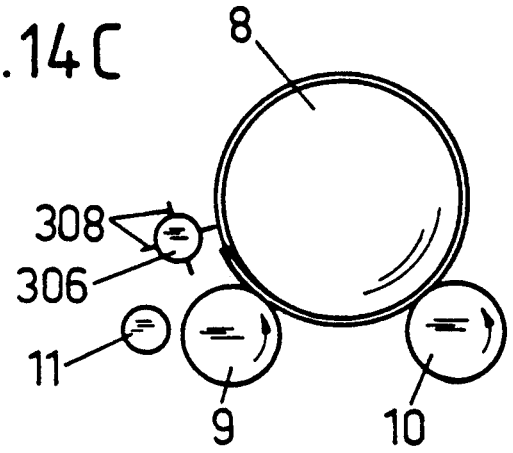
Figure 14A:
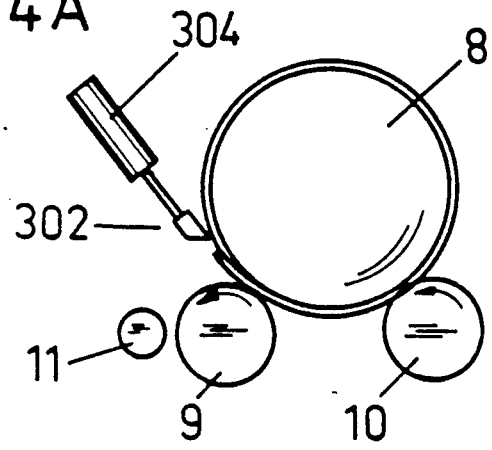
Figure 14B:
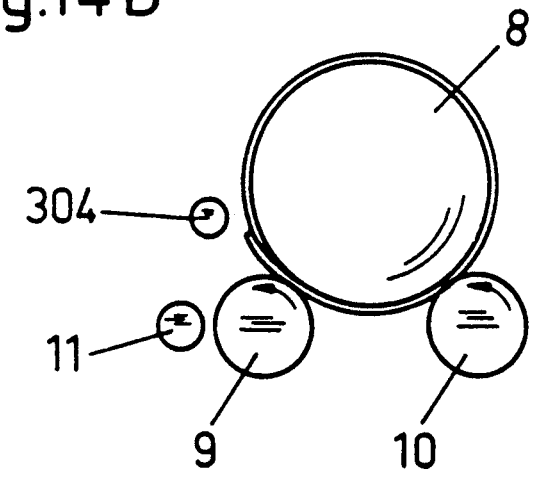

FIGS. 14A, 14B and 14C show respective modifications of the lap end finding arrangement. In each case, the outermost winding of lap on the roll is indicated diagrammatically. These arrangements can be used in case it is desired not to provide a perforated roller as the carrier roller 9 (FIG. 1). In FIG. 14A, a mechanical "scraper" 302 is used to "peel" the lap end off the roll as the latter is rotated by the carrier rollers. Scraper 302 extends over the whole width of the lap roll and is moved against the roll surface (e.g. by a piston and cylinder unit 304) in response to a signal from the control unit when a new lap roll is placed on the carrier unit (e.g. as shown in FIG. 5). The free edge of the scraper can be indented.

FIG. 14B shows a perforated tube or nozzle 304 which can be used to generate an airstream at the roll surface to peel off the lap end. This airstream can be generated by pressure air or by suction. The tube or nozzle 304 can also be moved into place (from a suitable withdrawn position, not shown) for the lap end finding operation. The tube or nozzle extends over the whole width of the lap roll.

FIG. 14C shows a roller 306 with radially extending "arms" 308 which can be brought against the external surface the roll to peel off the lap end. The roller 306 is also carried, for example by a swingarm (not shown), for movement between a with drawn position (not shown) and an operative position as illustrated. In the operative position, the roller can be rotated about its own longitudinal axis. Roller 306 also extends over the whole width of the lap roll.

FIG. 18 shows schematically a drive system suitable for an arrangement as shown in FIG. 1. In this arrangement, the lower pressing or joining roll 17 is driven from the normal combing machine drive system, replacing in this respect the lap roll carrier roller 100 (FIG. 9) which is normally integrated into the combing machine drive system. The operation of the roll 17 is therefore directly linked with the operation of the combing unit by the normal combing machine control system.

An auxiliary drive is now provided for the additional elements involved in the piecing operation, namely the carrier unit comprising the carrier rollers 9, 10 (together with pressure roll 11), and the transport or end-preparing rolls 13, 14.

A first auxiliary motor 340 is provided (for example in the machine end head) and is linked by a suitable transmission (for example a toothed belt 342) with gear wheels 344 associated with rollers 9 and 10 respectively. A tensioning roll 346 can be provided to keep the belt taut.

A second auxiliary motor 348 is provided (also, for example, in the machine end head) and is coupled for example by a toothed belt with a gear wheel 352 associated with the lower roll 14 of the roll pair 13, 14. The rolls 14, 17 can be formed as "cylinders" extending along the full length of the machine (i.e. associated with all combing heads on one machine side).

The drive arrangement shown in FIG. 18 is the preferred arrangement in which the end preparation is carried out by means of the auxiliary drive (acting an roller pairs 9, 11 and 13, 14) and the joining operation (performed by roll pair 16, 17) is integrated into the normal machine drive system i.e. is coupled with the drive to the combing unit.

The rolls 11, 13 and 16 are preferably formed as pressure rolls, that is, they are not driven directly but are mounted for free rotation about their own longitudinal axes. There can be one set of such pressure rolls for each combing head, that is, these rolls do not extend over the whole machine length but are associated with respective combing positions. The set of three pressure rolls 11, 13, 16 can be mounted on a common support frame 354 which is pivotally mounted on the machine frame (not shown) for example at 356. The support frame 354 can then be swung upwardly about the pivot mounting 356 to move the pressure rolls away from their drive cylinders and to give access to the lap movement path for servicing the combing head.

Referring to FIGS. 19 and 20, wherein like reference characters indicate like parts as above, the combing machine has a pair of joining or pressing rollers 16, 17, a pair of transporting or end preparation rollers 13, 14 and a further pair of transporting rollers 11, 9, one of which also serves as a lap roll carrier roller. The second lap roll carrier roller is indicated at 10. The drive arrangement is that diagrammatically illustrated in FIG. 18, comprising a motor 340 driving the carrier rollers 9, 10 and a motor 348 driving the transporting roller 14. These motors are additional to the main combing machine drive schematically illustrated at 360. Drive 360 operates the combing assembly (not shown in FIG. 19) and also the joining or pressing rollers 16, 17. A pulse signal generator 362 is included in the drive transmission to the roller pair 16, 17. This generator 362 provides a signal to a central control 364 which can thereby ensure synchronization of the auxiliary drives 340, 348 with the main combing machine drive 360 as and when necessary (e.g. during normal operation of the machine).

FIG. 19 concentrates upon the drive arrangements and their integration into the overall control system. As already described with reference to FIG. 18, the rollers 17, 14, 9 and 10 extend along the complete row of combing heads (in the case of a single-sided machine, or at least along one of the two rows of combing heads in the case of a double-sided machine). FIG. 20 on the other hand concentrates upon the sensors which are associated individually with each combing head. There are two such sensors in each combing head, namely a first sensor 366 to determine the presence or absence of lap on the tube 8*a* supported on the carrier rollers 9, 10, and a second sensor 368 to detect the presence or absence of lap on the path extending between the roller pairs 13, 14 and 16, 17.

The operation of the system can be seen from FIG. 21 which will first be described as a timing diagram. Section A of FIG. 21 illustrates the change in condition of the drive 340 to the transport rollers 13, 14 over a given time interval in which a piecing operation is carried out. Section B of FIG. 21 represents the condition of the drive 348 for carrier rolls 9, 10 over the same time interval. Section C represents the condition of the drive 360 for the combing machine (and in particular for the joining roller pair 16, 17) over the same time interval. Finally, sections D, E, F and G indicate respectively the operating conditions of the deflecting element 19, 20 (FIG. 1) the tube ejecting means 23 (FIG. 1), the vacuum source 370 (FIG. 19) for the suction removal system 26 and the source of vacuum (not shown) for a perforated end finding device represented in FIGS. 1 and 19 by the perforated carrier roll 9.

At time T0, the machine is in its normal operating condition so that all of the drives 340, 348, 360 are energized to feed lap for combing at a speed determined by the main drive unit 360. This speed is dependent upon a setting fed into the machine (e.g. manually) via the control system 364. The drives 340 and 348 are synchronized with the drive 360 by means of the output signal from generator 362 and the corresponding control signals fed to drives 340 and 348 from control unit 364. The other elements whose operating conditions are indicated in the diagram of FIG. 21 are inoperative at time T0.

At time T1, one of the sensors 366 (FIG. 20) detects the end of the lap in its combing head and sends a corresponding signal to the central control unit 364. Control unit 364 immediately cancels the synchronization of drives 340 and 348 with drive 360, taking direct control of the operating speeds of all motors. After a short delay, control unit 364 disables the drive 340 so that the carrier rollers 9, 10 come to a stop. The drives 348, 360 remain in their operative condition, so that the lap parts between the now stationary roller pair 9, 11 and the rotating transporting roller pair 13, 14.

After a predetermined time delay t, control 364 disables the main machine drive 360 so that the combing heads in general and the joining rollers 16, 17 in particular are brought to a stop. The time delay t may be made adjustably settable to ensure that the prepared lap end produced by the parting operation is correctly located relative to the joining rollers 16, 17 ready for the subsequent piecing operation.

At time T3, control 364 restarts the drive 340 for the carrier rollers 9, 10 as indicated in sections A and B of FIG. 21. The carrier rollers 9, 10 and the transport rollers 13, 14 are now accelerated to a relatively high speed (above the normal operating speed of these rollers) so that the lap remnants are removed via the suction system 26 as quickly as possible. The suction system itself has been previously energized, preferably at the time of first stopping of carrier rollers 9, 10.

Operation of drives 340 and 348 to feed lap remnants into the suction removal system 26 is continued until all of the sensors 368 (FIG. 20) have indicated to the control system 364 that no lap can be detected within their sensing fields. Control 364 therefore has to register the condition of each of the sensors 368 and can only proceed to the next stage of the piecing operation when the appropriate signal is received from the last sensor 368 to detect continuing presence of lap in its combing head. When the end of this last lap is detected (T4) control 364 switches off the drive 340 to the carrier rollers 9, 10 and decelerates transport rollers 13, 14 to the normal operating speed.

There follows a brief time interval in which the device 23 (FIG. 1) is operated (section F of FIG. 21) to eject the empty lap support tube 8*a* and a new lap roll is placed upon the carrier rollers 9, 10. The latter operation is not indicated in FIG. 21 because, although it is initiated by the machine control 364, the movements of the incoming lap rolls will be separately determined by a transport system control. During the interval in which new lap rolls are being put in place by the transport system, the combing machine itself will be inoperative but since this interval is very short, the drive to the transport rollers 13, 14 is continued.

At time T5, the transport system indicates to the control 364 that new lap rolls have been placed on the carrier rolls 9, 10 at each of the combing heads under the control of unit 364. This unit therefore causes restart of the carrier rolls 9, 10 to enable performance of a lap end finding operation as described with reference to preceding Figs. For this purpose, suction is applied to the perforated roller 9 (section G of FIG. 21). The drive 340 to rollers 9, 10 remains energized until the time T6 at which the last of the sensors associated with control unit 364 indicates that a new lap has been detected within its sensing field. The machine is therefore ready for the second end preparation step.

At time T6, therefore, unit 364 again switches off the drive 340 while maintaining drive to transport rollers 13, 14. The new lap therefore parts between roller pair 13, 14 and roller pair 9, 11 and the separated portion is immediately taken up by suction system 26 which is still operative. The second end preparation step is thus completed and it is now necessary to move the prepared end of the new lap forward in order to superimpose the end upon the prepared end of the old lap previously located at the joining rollers 16, 17.

After a predetermined time delay (not particularly indicated in the diagram) sufficient to allow the end preparation step (including removal of the waste material), drive 340 is restarted at time T7 in order to feed the prepared lap end forward to the joining rollers 16, 17. At about the same time, the deflecting means 19, 20 (FIG. 1) is operated as indicated in section D of FIG. 21. At time T8, after a further selectively adjustable time delay (not particularly indicated in FIG. 21), drive 340 and also drive 348 are deenergized by control unit 364 so that the feed of the new lap end ceases with that lap end correctly placed for joining with the old lap end. The adjustability of the time delay at this stage ensures correct superposition of the two prepared lap ends.

After a very short delay to ensure run out of the drives, the combing machine drive 360 is restarted at time T9. At this time also, the synchronizing control link from the signal generator 362 via the control unit 364 to the auxiliary drives 340, 348 is reestablished, so that the latter drives now operate in synchronism once more with the main comber drive 360. All of these drives are therefore accelerated in synchronism until they reach the normal operating speed and they continue in that condition until the next piecing operation is initiated by one of the sensors 366 (FIG. 20).

The deflecting device 23 (FIG. 1) is returned to its retracted position at some time after reestablishment of normal operating conditions, in order to set the machine in a predetermined state in readiness for the next piecing operation. The timing of this step is not critical, however, because the diverting plate 19 does not interfere with normal operation. The suction system 26 is deenergized by the control unit 364 at the time of extension of the diverting plate 19 to its operative position.

FIG. 21 has been interpreted in the above description in terms of a timing diagram corresponding to the use of timing means to cause initiation of the various operating steps and also to control the movements of the prepared lap ends. It may be preferred, however, to eliminate time as a control parameter for the latter function and instead to use pulse signals indicating the distance travelled by the relevant lap end. For example, in relation to the first prepared lap end (on the old lap), it would be possible to use pulses emitted by the signal generator 362 to control the positioning of the prepared lap end at the joining rollers 16, 17. The main combing machine drive 360 could then be continued in operation after the start of a parting operation until a predetermined number of pulses has been counted by the control unit 364. By this means, it is possible to avoid dependence of the positioning of the prepared lap end on the operating speed of the comber. This dependence arises where the optimizing setting is effected in terms of a time delay t.

The second adjustable timing operation to position a lap end (the interval T7 to T8) can be eliminated by using, e.g. stepping motors in the auxiliary drives 340 and 348 and supplying operating pulses under the control of the unit 364.

FIGS. 22 to 27 illustrate the basic structure and operating steps of a modified embodiment of a piecing apparatus for a comber of the same type as that illustrated in FIG. 1. In particular, the arrangement shown in FIGS. 22 to 27 is intended for use with a lap movement path involving a "knee-bend" 380 created (e.g.) by a pair of guide plates 113, 114 (FIG. 9). The arrangement shown in FIG. 22 comprises a pair of lap roll carriers 382, 384 and a pair of joining rollers 386, 388. The joining rollers are again located at the infeed end of the horizontal path section extending to the knee-bend 380.

The arrangement also includes auxiliary guide plates 381 ensuring at least partial enclosure of the path of the lap from the joining roller pair 386, 388 to the feed roller (not shown) of the combing assembly (also not shown in FIGS. 22 to 27).

The arrangement furthermore comprises a suction head 390 connected by a suitable pneumatic lead (not shown) to a vacuum source (not shown). This head 390 is located at a position below the length of lap travelling from the "leading" carrier roller 382 to the joining rollers 386, 388. However, under normal operating conditions (as illustrated in FIG. 22), the length of lap 385 extending between carrier roller 382 and roller pair 386, 388 is isolated from the suction head 390 by a guide plate 392 which is shown to a larger scale in the detail sketch FIG. 22A.

As shown in the FIG. 22A plate 392 is pivotally mounted at its edge nearest to carrier roller 382 on a pivot axis 394 parallel to the axis of the roller 382. A piston and cylinder unit 396 act between the plate 392 and the machine frame (schematically indicated at 398) to hold the guide plate 392 either in the operative position shown in FIG. 22 and in full lines in FIG. 22A or in a retracted position indicated in dotted lines in FIG. 22A. In this latter position, the lap path between carrier roller 382 and roller pair 386, 388 is exposed to the suction head 390.

Suction head 390 also has a special construction as illustrated in FIG. 22A. The mouth section of the suction head comprises a fixed wall 400 with a lip 402 and a movable wall 404 pivoted on an axis 406 to the main head structure and provided at its outer end with a lip 408. By means of a suitable operating device 410, the wall section 404 can be pivoted around the axis 406 to move the lip 408 towards and away from the lip 402, thus forming an openable and closable clamping nip at the mouth of the suction head. A further controllably adjustable means (not shown) is provided to move the complete suction head 390 relative to the other illustrated elements, as will become apparent from the description of the subsequent Figs.

When a signal is received from one of the combing heads indicating that lap is about to run out (e.g. from a sensor 366 as described with reference to FIGS. 20 and 21), the drive to the roller pair 386, 388 is terminated while the drive applied to the carrier rollers 382, 384 is continued. Plate 392 is pivoted from its normal operating condition (FIG. ) into its retracted position (FIG. 23) and the loop 412 of lap formed between the roller 382 and the roller pair 386, 388 is taken into the suction head 390 to which suction has been applied. At this time, wall 404 of head 390 is pivoted to a position at which the mouth of the suction head is unrestricted to take up the double thickness of lap.

After an adequate length of the looped lap has been taken up by the suction head 390, the drive to carrier rollers 382, 384 is terminated, wall 404 is pivoted to move lip 408 into a clamping position relative to lip 402, and suction head 390 is moved away from the rollers 388, 382 as indicated by the arrow D in FIG. 24. The looped length of lap held by the clamping nips 402, 408 within the suction head is therefore parted from the lap extending through roller pair 386, 388 to the combing head (not shown) and also from any remaining lap extending back over the roller 382. By observance of the conditions already described in relation to the preceding Figs., it is possible in this way to produce a properly prepared end 413 on the lap still extending to the combing assembly. In addition to parting the length of lap in the suction head 390 from the length of lap still threaded with the rollers 386, 388, the suction head 390 serves to extract loose fiber from the lap end held by the rollers 386, 388 and thereby form a prepared end for the piecing operation. By appropriate dimensioning of the parts relative to each other, it will be possible to avoid the necessity to reposition this prepared end 413 relative to the joining rollers 386, 388.

The mouth of suction head 390 is now reopened to enable removal of the waste material from the clamping nip 402, 408. Any remnant lap 415 extending back over the carrier roller 382 is also removed by restarting feed of the carrier rollers 382, 384 while maintaining suction on the head 390.

In an alternative, preferred arrangement, feed of a loop (double thickness) of lap into the suction head 390 continues until all of the lap has been removed from the (now) empty tube 414. Accordingly, when the nip 402, 408 is closed, it clamps only the single remaining thickness of lap extending from the suction head 390 to the roller pair 386, 288. Parting of this section of lap, with simultaneous formation of a prepared lap end, is then carried out as already described above. With this arrangement, there is clearly no need to restart the carrier rollers 382, 384 after an end preparation step merely to enable removal of lap remnants, since they have already been removed as a preliminary to the end preparation step itself. Complete removal of the lap remnant is indicated by a sensor 381 having a sensing field including the carrier roller 382.

The empty lap support tubes 414 (FIGS. 22 to 24) can then be ejected and replaced by fresh lap rolls 417 (FIGS. 25 to 27) as previously described. The suction head 390 is then moved through the gap between the carrier roll 382 and the pair of joining rolls 386, 388 to a take-up position to receive the end 419 of the new lap. In this position, the suction head 390 can cooperate with other lap end finding elements as previously described with reference to the other drawings. A suitable sensor (not shown) can be provided along the tube leading to the suction head 390 in order to indicate the presence of lap within that tube, and hence the success of the end finding operation. The drive to carrier rollers 382, 384 is then terminated once again whereupon the clamping arrangement at the mouth of suction head 390 is operated to clamp the found lap end. The head itself is withdrawn back through the gap between the carrier roller 382 and roller pair 386, 388 (FIG. 26). In the course of this movement, the new lap is parted just upstream from the clamping nips 402, 408 so that the fresh leading end 416 of the new lap is properly prepared for joining with the previously prepared end 413 of the old lap.

The device 396 (FIG. 22A) is now reoperated in order to return guide plate 392 to its normal operating position (FIG. 27). The prepared leading end 416 of the new lap is therefore placed in a position in readiness for joining with the prepared end 413 of the old lap. The clamping nip 402, 408 can now be released, the waste material removed by suction and the suction then terminated.

The carrier rollers 382, 384 are now restarted to move the prepared leading end 416 of the new lap into the nip of the roller pair 386, 388. At the same time, the latter roller pair is restarted so that the two prepared lap ends are brought together in the nip of the joining rollers and are thereby pressed firmly together. The join then follows the normal path via the knee-bend 380 into the combing assembly as already described with reference to the preceding Figures.

FIG. 28 illustrates a modification of the arrangement described with reference to FIGS. 22 to 27. In the arrangement as shown in FIG. 28, the pair of joining rollers 386, 388 is provided at the knee-bend 380 so that the lap leaving these rollers is diverted downwardly directly into the combing assembly (not shown). The arrangement is otherwise identical to that shown in FIGS. 22 to 27. In this case, however, the lower joining roller 388 would be required to perform a swinging movement in synchronism with the operation of the combing assembly and it would accordingly be preferable to provide this lower roller as a pressure roller which is driven only by contact with the driven upper roller 386. The latter can be withdrawn from contact with roller 388 when the piecing operation has been completed.

FIG. 29 shows a modification of the device for moving the guide plate 392 (FIG. 22A). In the modified arrangement, this plate 392 is carried by a pair of pivotable levers 391, 393 pivotable about a common axis 395 "forward" of the joining rollers 386, 388. The guide plate 392 is pivotable about this axis between a first position (full lines) in which the guide plate 392 is located to guide material to the joining rollers and a second position (dotted lines). In this latter position, the suction head 390 can take up material delivered from the carrier rolls 382, 384 and can be moved to an end finding position as shown in FIG. 25. When the guide plate 392 is swung back to its operative or first position, the leading edge is in a position very close to the joining roller 388 to guide the new lap end safely onto the previously prepared end on the old lap.

FIGS. 30 to 32 illustrate a further possibility for parting a lap to form a prepared lap end. In this case, joining rollers 440, 442 form a stationary clamping nip to grip the lap while the lap is drawn apart by reverse rotation of the carrier rollers 444, 446. Rollers 440, 442 could therefore in this case be replaced by a clamping nip in the form of a pair of nipper jaws which are closed just prior to an end preparation step. The prepared end 447 rests, in this case, on a guide plate 443 fixed between the leading carrier roller 444 and the pair of joining rollers 440, 442.

The weight of an empty tube 448 resting on the carrier rollers 444, 446 may not be sufficient to ensure that the reverse rotation of the rollers 444, 446 is effectively transferred to the lap, therefore retracting and causing the lap to part upstream from the roller pair 440, 442. Accordingly, a pressing means is preferably provided to press the empty tube 448 down onto the rollers 444, 446 while allowing the tube itself to rotate about its own axis. The tube 448 therefore forms a nip 450 together with the front carrier roller 444, and this is adequate (on reverse rotation of roller 444) to draw back the lap and cause the required severing operation.

FIG. 31 illustrates an appropriate pressing means in the form of a pair of carrier rods 452, 454, each pivotally connected at one end to the reciprocable connecting rod 456 of double-acting piston and cylinder unit 458. Each carrier rod 452, 454 is pivotally mounted between its ends on a support 460 which is fixed to part of the machine frame 462 between the lap carrier rollers 444, 446 and the pair of lap carrier rollers (only one roller 464 visible in FIG. 31) for feeding material to the adjacent combing head. Each rod 452, 454 has a roller 466 rotatably mounted on a free end.

When piston and cylinder unit 458 is operated in one sense, the rods 452, 454 are moved to an inoperative position (dotted lines) in which they do not interfere with empty tubes 448 at the associated (adjacent) combing stations (or with the laps previously carried by those tubes). However, as one step in placing the machine in condition for a piecing operation, unit 458 is operated to move rods 452, 454 to their operative positions (full lines) in which each roller 466 engages the internal surface of the associated empty tube 448 to push the tube down firmly onto the respective carrier rollers 444, 446 or 464, thereby ensuring a firm drive connection between the tube and the carrier rolls sufficient to form a clamping nip for retracting the lap remnant (not shown) and causing a part upstream from joining rollers 440, 442. Each tube 448 has two associated pressing rollers 466, one at each end of the tube.

The pressing means could of course apply a force to the exterior of the tube 448 and could even be provided by the incoming lap resting on the old tube. However, it is preferred to provide a device directly under the control of the machine and located at a position such that it cannot interfere with an incoming lap.

The lap remnant severed from the old lap section still extending through the joining rollers 440, 442 to the combing assembly is carried away by a suction device having a suction head 470 (FIG. 30) provided adjacent the trailing or rearward carrier roller 446. For this purpose, the rotation of the carrier rollers 444, 446 in the reverse sense is continued until the severed end of the lap remnant is moved beyond the mouth of suction head 470 and the rotation of these rollers is then reversed again so that they rotate once more in the normal feed direction. As the severed end of the lap remnant is brought back over the mouth of the suction head, the end is separated from the tube 448 and diverted into the suction head by air flows generated by the suction then applied. Rotation of the tube is continued in the normal feed sense until a suitable sensor 469 indicates that all the remnant has been taken into the suction head.

The now empty tube 448 is first released by operation of unit 458 (FIG. 31) to retract the pressing rollers 466 and is then ejected by a suitable mechanism (for example as previously described). A fresh lap 480 (FIG. 32) is then placed on the carrier rollers 444, 446 by means of a transport system also as previously referred to. The fresh lap 480 is so positioned that the free lap end 482 lies close to but "upstream" from the rear carrier roller 446 considered in the normal direction of rotation of the lap for feed of material into the combing head, i.e. in a clockwise direction as viewed in FIG. 32.

The carrier rollers 444, 446 are now set in rotation in the normal direction of feed and the free lap end 482 is thus brought into alignment with the suction head 470 which is still subjected to underpressure from a manifold 484. The free lap end is peeled off the lap by the suction air flow and is drawn into the suction lead 470.

Suction head 470 is similar to the suction head 390 described with reference to FIG. 22A and has an openable and closable mouth portion comprising a lip 486 on a part 488 joined to the main body of the suction head by means of a flexible strip 490. A piston and cylinder unit 492 is provided to open and close the mouth portion thereby opening and closing a clamping nip formed by the lip 486 and the surface of the suction head facing that lip.

The manifold 484 is carried by a link 494 pivotable about the axis of the rear carrier roller 446. Thus, when the free lap end has been taken in by the suction head 470 (which can be detected by a suitable sensor, not shown, in the suction head itself), the carrier rollers 444, 446 are stopped, the clamping nip at the mouth of suction head 470 is closed by operation of unit 492 and the manifold 484 is pivoted in an anti-clockwise direction (as viewed in FIG. 32) around the axis of the roller 446. The lap section held by the clamping nip in head 470 is thereby parted from the fiber "fringe" or "beard" projecting from the "nip" formed between the main body of the lap roll itself and the rear carrier roller 446. By attention to the end preparation requirements already explained with reference to FIGS. 15A and 15B, a properly prepared end is thereby provided on the fresh lap.

The lap 480 is now again rotated in the normal feed direction (by setting carrier rollers 444, 446 in rotation) to move the prepared lap end to a position just downstream of the leading or front carrier roller 444 (considered in the normal feed direction). An end finding device (diagrammatically indicated at 494) is provided to peel the freshly prepared end off the main body of the lap as already generally described with reference to preceding Figs.

The newly found end is then permitted to drop onto the guide plate 443 which is still carrying the previously prepared end of the old lap as already described with reference to FIG. 30. A mechanical device (not shown) could be provided both to assist peeling of the new lap end off the main lap roll, to direct it downwards onto the plate 443 with the old lap end and to hold those lap ends together as the system is restarted to move the superposed ends into the joining rollers 440, 442. The machine can then proceed normally with the combing operation.

Referring to FIG. 33 the pressing means for urging lap core or tube 448 against a the lap carrier rolls 464 (only one roll visible in FIG. 33) may include a pair of rollers 480. As shown, the rollers 480 are independently mounted, one at each end of the tube 448 when the latter is in a normal position on the carrier rolls 464. Each roller 480 is carried by a piston (not visible in FIG. 33) of an individual piston and cylinder unit 482 operable to reciprocate the respective roller 480 between a retracted position (shown in full lines in FIG. 33) and an extended position (partially shown in dotted lines). Each roller 480 is freely rotatable on a rod (not visible in FIG. 33) connecting the roller with its associated piston so as to rotate on a common axis of rotation with the other roller. Each roller 480 has a frusto-conical end portion 484 which engages a corresponding bevelled surface 486 on the adjacent end of the tube 448.

As indicated in FIG. 33, the carrier rolls 464 can be fluted. When the pressing rollers 480 are urged into their extended positions, the contact with the bevelled surfaces 486 forces the tube 448 downwardly onto the fluted rolls 464 and forms an adequate friction drive connection such that the rollers 480 rotate with the tube 448.

FIG. 34 shows a modification of the pair of joining or pressing rolls 440, 442 with a means provided for moving the upper roll 440 between an operative position for pressing laps ends together and a retracted position. In the arrangement shown, the moving means includes a piston (not seen) of a piston and cylinder unit 488 connected to the upper roll 440 for movement of the roll 440 between the retracted position (shown in full lines) and an extended or operative position (partly illustrated in dotted lines). When in the operative position, the upper roll 440 forms the nip required for end preparation and for piecing the lap ends. The upper roll 440 can be retracted when these operations have been completed.

The lower roll 442 is driven by suitable means (not shown) and is freely rotatable on its support. The drive to the lower roll 442 may be switched off when the upper roll 440 is retracted. The lower roll 442 then serves as a simple guide.

In the embodiment shown in FIG. 32, pivoting of the manifold 484 may be unnecessary if the rolls 444, 446 are again set in rotation in the reverse sense to rotate the fresh lap after its end has been fed into suction device 470 and clamped therein. It is of course also possible to perform the end preparation step on the new lap by both pivoting the manifold 484 and simultaneously setting the rolls 444, 446 in reverse rotation.

FIG. 35 indicates diagrammatically the application of the invention to an alternative type of lap processing machine, known as a ribbon lap machine. This machine is used in preparing the laps to be fed to the combing machine itself. The ribbon lap machine is the second machine in a pair of combing preparation machines, the first machine (the sliver lap machine) of the pair converting sliver infeed material to a lap and the second machine (the ribbon lap machine) drafting and doubling the resultant laps to ensure an appropriate feed to the comber. Accordingly, there is also a need for a good piecing system to enable automated operating of the ribbon lap machine. Further details of the ribbon lap machine can be found in the book of Zoltan S. Szaloki already referred to.

The conventional ribbon lap machine includes, as indicated in FIG. 35, a pair of lap carrier rolls 500, 502 essentially the same as those shown, for example, at 444, 446 in FIG. 30. The full lap (partially indicated in dotted lines at 504) presented to the ribbon lap machine for processing therein is also formed on a central core or support tube 506, which remains resting on the rolls 500, 502 when the feed lap is exhausted.

A guide plate 508 is conventionally provided between the lap carrier unit 510 and a lap processing unit provided in this machine by a drafting unit 512. The drafting unit comprises three drafting zones defined between an infeed roller pair 514, a delivery roller pair 516 and two middle roller pairs 518, 520. The sets of upper and lower drafting rollers have respective cleaning belts 522, 524, which run around drive and guide rollers 526. The moving clearing belts collect lint from the sides of rollers remote from the nips between the roller pairs.

After leaving the drafting unit 512, the drafted lap is doubled with laps similarly drafted in neighboring drafting heads, and the doubled laps are fed to a lap roll building unit (not shown). This aspect of the machine is irrelevant to the present invention and will not be dealt with further herein.

The conventional arrangement shown in FIG. 35 can be modified as follows to enable operation in accordance with the present invention:

1. a lap tube ejecting mechanism 534 (FIG. 6), for example as shown in FIG. 1 at 23 or in FIG. 13, is associated with the lap roll carriers 500, 502,
2. a pair of pressing or joining rollers 530 (FIG. 6) is provided, similar to the rollers 386, 388 in FIG. 22 or the rollers 440, 442 in FIG. 30,
3. an end preparation device is provided to prepare the end of an outgoing lap to be located just upstream from the joining or pressing rollers (this device could be in the form of a suction unit 532, FIG. 6, such as the unit 390 in FIG. 22, or it could comprise means to use the empty lap support tube to form a nip as described with reference to FIG. 31 and FIG. 33),
4. an end preparation device is also provided to prepare the end of the incoming lap (this device can be the device 532 as referred to under Point 3 above, or it can be a separate end preparing device, for example the unit 470 in FIG. 30).

The piecing procedure for a ribbon lap machine so modified is identical to that already described with reference to the combing machine, so that it is not believed necessary to repeat the piecing sequence or the details of the drives and control sequences.

A modified arrangement with additional elements 530, 532, 534 has been shown by way of example only in FIG. 36, but it will be clear that the other modifications broadly outlined above are equally possible.

What is claimed:

1. A method of joining an incoming lap with an outgoing lap extending to a lap processing unit in a textile machine comprising the steps of preparing a trailing end of an outgoing lap;

preparing a leading end of an incoming lap;

superimposing the prepared ends to join the laps; and feeding the joined laps to the lap processing unit.

2. A method as claimed in claim 1 wherein at least one of the said preparing steps comprises the step of reducing the fiber mass per unit length of lap in the prepared end.

3. A method as claimed in claim 2 wherein each said preparing step involves a gradual reduction in the fiber mass per unit length towards the free lap end and wherein the mass of fiber per unit length in the join region is approximately equal to the mass of fiber per unit length along the laps.

4. A method of joining laps in a textile machine comprising the steps of clamping an outgoing lap extending to a lap processing unit along a nip line;

severing the lap upstream in the direction of material flow of said nip line while combing out the lap extending from the nip line to the severed end to form a trailing end having a gradual reduction in fiber mass per unit of length towards said trailing end;

clamping an incoming fresh lap extending from a roller along a nip line;

severing the fresh lap downstream in the direction of material flow of said second nip line while combing out the lap extending from said second nip line to the severed end to form a leading end having a gradual reduction in fiber mass per unit of length towards said leading end;

thereafter clamping an incoming fresh lap extending from a roller along a pair of nip lines spaced apart a distance greater than the longest fiber in the fresh lap.

5. A method as set forth in claim 4 wherein combing out of said end of each lap is effected under suction.

6. A textile machine comprising at least one lap processing unit;

a carrier means for supporting a roll of lap to be combed;

means to form a prepared end on a length of outgoing lap extending to said lap processing unit;

means to support said length of outgoing lap upstream from said lap processing unit with said prepared end in a substantially predetermined position, means to form a prepared end on an incoming lap; and means to bring the prepared ends together and to feed said ends in joined relation to said unit.

7. A textile machine comprising at least one lap processing unit;

a carrier means for supporting a roll of lap to be processed;

means to prepare the trailing end of an outgoing lap and the leading end of an incoming lap;

means to bring said prepared ends together by superposition; and means for forwarding the laps with the superposed ends to said unit.

8. A machine as claimed in claim 7 wherein said means to prepare the trailing end on the outgoing lap and to prepare the leading end on the incoming lap includes means to form a tapered end on each said lap.

9. A textile machine comprising a lap processing unit;

a pair of joining rollers;

a carrier means for supporting a roll of lap to be processed; and a selectively operable device for pressing a lap tube against said carrier means to form a friction drive connection therebetween.

10. A textile machine comprising a lap processing unit; a pair of joining rollers means to perform a lap end preparation step in preparation for piecing of lap ends, said means comprising a suction take-up device with an adjustable mouth portion for selectively forming a clamping nip.

11. A textile machine comprising a lap processing unit; a pair of joining rollers means to perform a lap and preparation step in preparation for piecing of lap ends, said means comprising means selectively operable to urge a lap tube against a lap carrier to form a friction drive connection therebetween.

12. A method of preparing an outgoing lap for joining with an incoming lap in a textile machine comprising the step of urging a lap support tube into contact with a carrier unit to form a friction drive connection to withdraw lap from a nip downstream from the carrier unit.

13. A method of preparing a lap end for joining in a textile machine comprising the step of taking up the lap in a suction device having an adjustable mouth portion selectively operable to clamp the lap.

14. A textile machine comprising a lap processing unit, a lap end joining means and a guide means for providing guidance for the joined lap ends on two opposed faces thereof as they move from the joining means to said unit.

15. A textile machine comprising a carrier means having at least one roller for supporting a lap roll thereon;

a lap processing unit having lap processing elements for receiving a lap from said carrier means;

means defining a clamping nip between said carrier means and said unit for holding a lap thereat;

a guide plate between said carrier roller and said nip for guiding a lap from said carrier roller to said nip;

a suction head for receiving and extracting loose fiber from a leading end of a fresh lap on said carrier means;

control means connected to said carrier roller for reversing rotation of said roller to effect tearing of a lap between said nip and said roller to form a trailing end for laying on said guide plate, and for subsequently rotating said carrier roller to deliver the leading end of a fresh lap onto said guide plate.

16. A machine as set forth in claim 15 wherein said means is a roll pair.

17. A machine as set forth in claim 15 wherein said carrier means includes a pair of said rollers for supporting a lap roll thereon and said suction head is disposed between said carrier rollers.

18. A machine as set forth in claim 15 which further comprises a pressing means for biasing a lap roll against said carrier roller.

19. A machine as set forth in claim 18 wherein said pressing means includes a pair of pressing rollers, each pressing roller being disposed at respective ends of said carrier roller and being movable into a position inside a lap roller on said carrier roller for pressing the lap roller against said carrier roller.

20. A machine as set forth in claim 19 wherein each said pressing means is pivotally mounted for movement into and out of a lap roller.

21. A machine as set forth in claim 19 wherein said pressing rollers are reciprocally mounted on a common axis, each said pressing roller having a frusto-conical end position for engaging a bevelled surface within a carrier roller.

22. A machine as set forth in claim 21 wherein said carrier roll is fluted.

23. A machine as set forth in claim 15 wherein said means defining said nip includes a pair of rolls and means for moving one of said rolls relative to the other of said rolls to define said nip in an operative position of said one roll.

24. A textile machine comprising at least one lap processing unit;

a carrier means for supporting a roll of lap thereon;

a pair of joining rollers for pressing superimposed laps ends to each other to join said ends; and means for moving at least one of said joining rollers between an operative position for pressing said lap ends together and a retracted position.

25. A machine as set forth in claim 24 wherein said unit is a combing unit.

26. A machine as set forth in claim 24 wherein said unit is a drafting unit.

27. A method of joining an incoming lap with an outgoing lap extending to a lap processing unit in a textile machine comprising the steps of severing an outgoing lap;

supporting a severed length of the outgoing lap between the lap processing unit and a lap joining means downstream from a carrier for an incoming lap; bringing the end of an incoming lap together with the outgoing lap at said lap joining means; and feeding the joined laps to the lap processing unit.

28. A method of joining laps in a textile machine comprising the steps of clamping an outgoing lap extending to a lap processing unit along a pair of nip lines spaced apart a distance greater than the longest fiber in the lap;

tearing the lap between said nip lines to effect at least a prepared trailing end on the lap extending to the lap processing unit, said end having a gradual reduction in fiber mass per unit of length towards said trailing end;

thereafter clamping an incoming fresh lap extending from a roller along a pair of nip lines spaced apart a distance greater than the longest fiber in the fresh lap;

tearing the fresh lap between said nip lines to effect at least a prepared leading end on the fresh lap, said leading end having a gradual reduction in fiber mass per unit of length towards said leading end;

thereafter superimposing said ends; and then pressing the superimposed ends to effect a join having a fiber mass per unit of length equal to the fiber mass per unit of length in a respective lap.

29. A method as set forth in claim 28 wherein one of said nip lines is moved away from the other of said nip lines to effect tearing of a respective lap therebetween.

30. A method as set forth in claim 28 wherein said distance between said nip lines is from 60 to 120 millimeters.

* * * * *

UNITED STATES PATENT AND TRADEMARK OFFICE

CERTIFICATE OF CORRECTION

PATENT NO. : 5,027,475

DATED : July 2, 1991

INVENTOR(S) : GIAN-CARLO MONDINI, et al

It is certified that error appears in the above-identified patent and that said Letters Patent is hereby corrected as shown below:

In the Abstract, last line, change "produced" to -produced-
Column 8, line 23 change "8" to -8'-

Column 10, line 22 change "en" to -end-
Column 12, line 45 change "end" to -and-
Column 15, line 23 change "with drawn" to -withdrawn-
Column 19, line 62 change "(Fig.)" t o -(Fig. 22)-
Column 23, line 51 cancel "a"

Signed and Sealed this

Ninth Day of February, 1993

*Attest:*

STEPHEN G. KUNIN

*Attesting Officer*

*Acting Commissioner of Patents and Trademarks*